US007757656B2

(12) United States Patent
Hoi et al.

(10) Patent No.: US 7,757,656 B2
(45) Date of Patent: Jul. 20, 2010

(54) INTERNAL COMBUSTION ENGINE FOR SMALL PLANING BOAT

(75) Inventors: Yosuke Hoi, Saitama (JP); Hiroyuki Kaga, Saitama (JP); Michio Izumi, Saitama (JP); Hiroyuki Makita, Saitama (JP); Kazuhiko Tomoda, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/802,712

(22) Filed: May 24, 2007

(65) Prior Publication Data

US 2007/0272194 A1 Nov. 29, 2007

(30) Foreign Application Priority Data

May 26, 2006 (JP) ..... 2006-147222

(51) Int. Cl.
*F01M 1/02* (2006.01)

(52) U.S. Cl. ..... 123/196 R

(58) Field of Classification Search ..... 440/75, 440/111; 184/106, 104.3, 104.2; 123/196 R, 123/196 S, 196 AB
See application file for complete search history.

(56) References Cited

U.S. PATENT DOCUMENTS 1,976,772 A * 10/1934 Clarke ..... 123/196 AB
5,846,102 A * 12/1998 Nitta et al. ..... 440/1
5,937,817 A * 8/1999 Schanz et al. ..... 123/196 AB
6,027,384 A * 2/2000 Nitta et al. ..... 440/75
7,350,497 B2 * 4/2008 Hiraoka et al. ..... 123/196 R
2006/0068656 A1 3/2006 Hoi

FOREIGN PATENT DOCUMENTS

JP 2003-35201 A 2/2003

* cited by examiner

*Primary Examiner*—Stephen K Cronin
*Assistant Examiner*—Keith Coleman
(74) *Attorney, Agent, or Firm*—Birch, Stewart, Kolasch & Birch, LLP

(57) ABSTRACT

An internal combustion engine for a small planing boat for reducing the lateral width of an oil pan in conformity to the configuration of the bottom while securing the filtering surface area of an oil strainer. In addition, a vertical width of the oil pan is maintained to be small to thereby lower the total height of the internal combustion engine. In an internal combustion engine for a small planing boat, an oil pan is provided at the bottom portion of the internal combustion engine with an oil passage for communicating with an oil pump being formed inside the oil pan. A vertical wall of the oil passage is partially cut away to form communication openings each communicating between the inside and outside of the oil passage with the oil strainers being interposed in the communication openings substantially vertically to divide the oil passage into inside and outside.

16 Claims, 15 Drawing Sheets

INTERNAL COMBUSTION ENGINE FOR SMALL PLANING BOAT

CROSS-REFERENCE TO RELATED APPLICATIONS

The present application claims priority under 35 USC 119 to Japanese Patent Application No. 2006-147222 filed on May 26, 2006 the entire contents of which are hereby incorporated by reference.

BACKGROUND OF THE INVENTION

1. Field of the Invention

The present invention relates to an internal combustion engine mounted in a small planing boat that planes across the water.

2. Description of Background Art

In a small planing boat, an internal combustion engine for driving a jet propulsion pump is mounted inside a boat body surrounded by the hull and the deck, and an occupant such as an operator rides on the deck. Accordingly, the space inside the boat body, which is formed by the hull and the deck and in which the internal combustion engine is accommodated in a substantially hermetically enclosed manner, is narrow.

The internal combustion engine is thus required to be compact. Further, as the lubricating system for the internal combustion engine, there has been adopted a dry sump in which no such oil reservoir for storing a large amount of oil as will cause an increase in overall height is provided in a lower portion of the engine. See, for example, JP-A No. 2003-35201.

Although the oil pan disclosed in JP-A No. 2003-35201 is not for storing a large amount of oil but serves only as a receiving pan at best, some amount of oil can be stored in the oil pan, and the stored oil is sucked up by an oil pump to be introduced into an oil tank.

Inside the oil pan, an oil strainer is provided under tension in a substantially horizontal position. The stored oil is sucked up through this oil strainer and foreign matter is removed.

Since the oil strainer is provided under tension in a substantially horizontal position inside the oil pan, the oil pan is required to have a certain lateral width. Thus, it is not easy to make the oil pan conform to the configuration of the center bottom portion of the small planing boat slanting laterally upwardly.

Further, a space having a certain vertical width is also required above and below the oil strainer placed in a horizontal position. Thus, it is not necessarily easy to reduce the vertical width of the oil pan.

SUMMARY AND OBJECTS OF THE INVENTION

The present invention has been made in view of the above-mentioned problems. Accordingly, it is an object of an embodiment of the present invention to provide an internal combustion engine for a small planing boat that makes it possible to reduce the lateral width of an oil pan in conformity to the configuration of the bottom of the small planing boat while securing the filtering surface area of an oil strainer, and also to keep the vertical width of the oil pan small to thereby lower the total height of the internal combustion engine.

In order to attain the above-mentioned object, according to an embodiment of the present invention, there is provided an internal combustion engine for a small planing boat, in which an internal combustion engine for driving a jet propulsion pump is mounted inside a boat body surrounded by a hull and a deck with a crankshaft orientated in a longitudinal direction of the boat body, wherein an oil pan is provided at a bottom portion of the internal combustion engine with an oil passage that communicates with an oil pump that is formed inside the oil pan. A vertical wall of the oil passage is partially cut away to form a communication opening communicating between the inside and outside of the oil passage. An oil strainer is interposed in the communication opening substantially vertically so as to divide the oil passage into an inside and outside.

According to an embodiment of the present invention, the communication opening of the oil passage in which the oil strainer is interposed is formed in a rear end portion of a main body of the internal combustion engine.

According to an embodiment of the present invention, the oil strainer is held between the oil pan and a crankcase of the internal combustion engine.

According to an embodiment of the present invention, the oil passage is formed in a longitudinally elongated configuration at a center portion of the oil pan, the communication opening is formed in a rear portion of each of left and right vertical walls of the oil passage, and the oil strainer is interposed in each of the communication openings.

According to an embodiment of the present invention, with respect to the left and right strainers, at least one oil strainer is inclined toward the center as the oil strainer extends rearwardly.

According to an embodiment of the present invention, the internal combustion engine for a small planing boat includes the oil strainer that is interposed substantially vertically in the communication opening, which is formed as the vertical wall of the oil passage inside the oil pan that is partially cut away, so as to divide the oil passage into an inside and outside. Accordingly, by orienting the oil strainer in a substantially longitudinal direction, the lateral width and vertical width of the oil pan can be reduced while securing a sufficient space on the left and right sides, thereby facilitating conformity to the configuration of the center bottom portion of the small planing boat slanting laterally upwardly. Further, the total height of the internal combustion engine can be lowered.

According to an embodiment of the present invention, the internal combustion engine for a small planing boat includes the communication opening wherein the oil strainer is interposed that is provided in the rear end portion of the internal combustion engine main body, upon acceleration of the small planing boat, the oil inside the oil pan becomes accumulated at the rear of the internal combustion engine. Accordingly, even when the amount of stored oil is small, it is possible to secure the oil that passes through the oil strainer.

According to an embodiment of the present invention, the internal combustion engine for a small planing boat includes the oil strainer that is held between the oil pan and the crankcase of the internal combustion engine, the attachment of the oil strainer is easy, thus providing superior ease of assembly.

According to an embodiment of the present invention, the internal combustion engine for a small planing boat includes the communication opening that is formed in a rear portion of each of the left and right vertical walls of the oil passage, which is formed in a longitudinally elongated configuration at a center portion of the oil pan, and the oil strainer is interposed in each of the communication openings. It is thus possible to reduce the lateral width and vertical width of the oil pan while securing a sufficient filtering surface area.

According to an embodiment of the present invention, the internal combustion engine for a small planing boat includes left and right strainers, at least one oil strainer is inclined toward the center as it extends rearwardly, thereby making it possible to secure a large filtering surface area for the oil strainer provided in the rear end portion of the internal combustion engine main body, and allow oil to be efficiently filtered to be recovered into the oil pump.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

An embodiment of the present invention will now be described below with reference to FIGS. 1 to 20.

Figure 1:
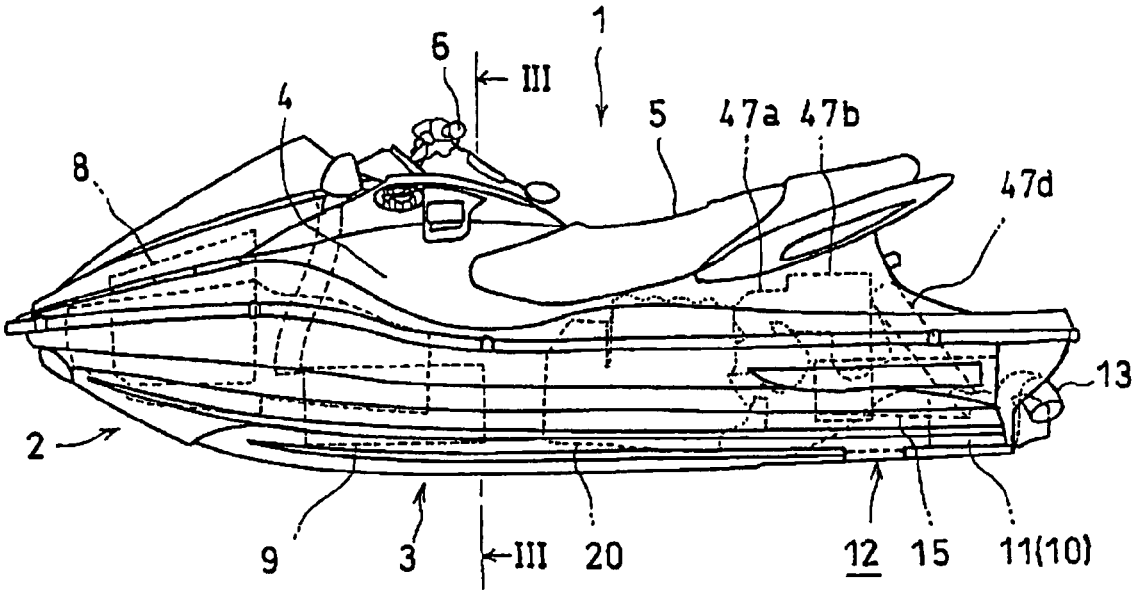
FIG. 1 is a side view of a small planing boat incorporating an internal combustion engine according to an embodiment of the present invention.
Figure 2:
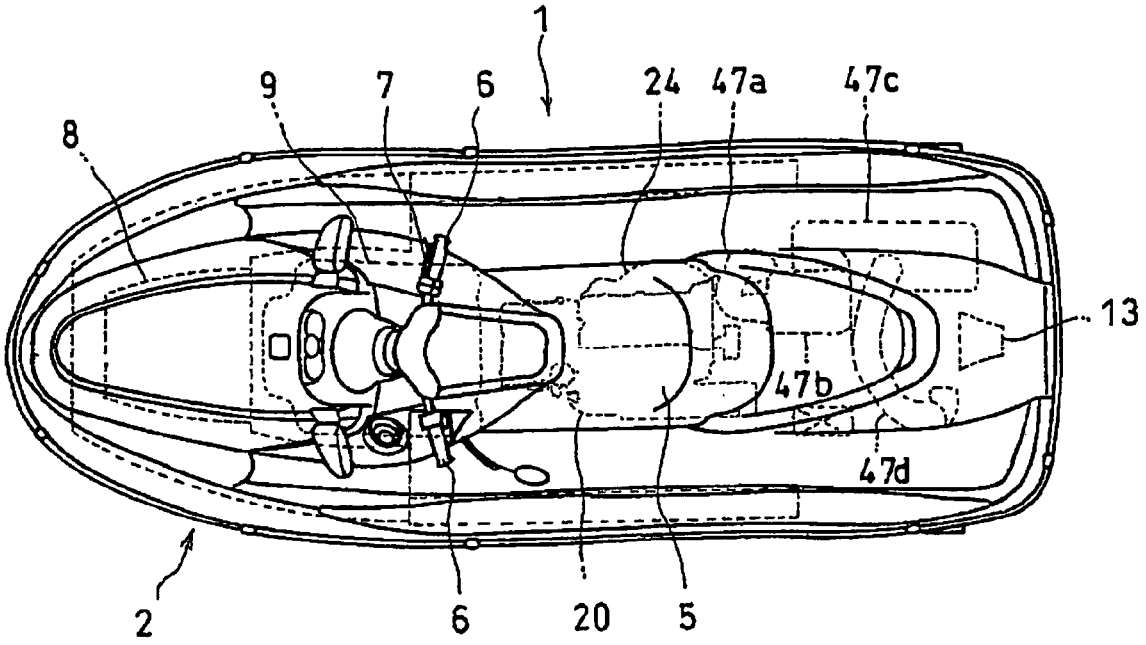
FIG. 2 is a plan view of the same.
Figure 3:
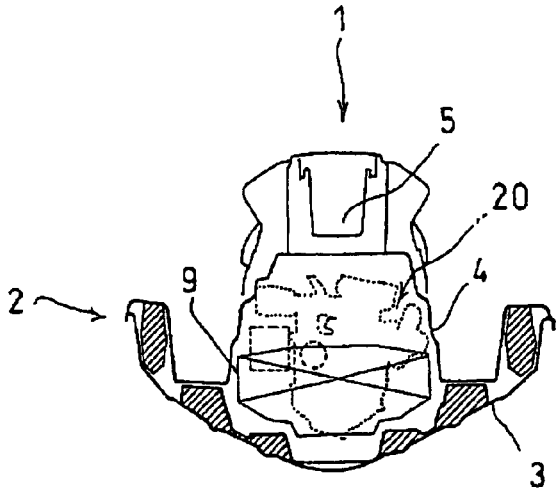
FIG. 3 is a sectional view taken along the line III-III of FIG. 1.

FIG. 1 is a side view of a small planing boat 1 incorporating an internal combustion engine for small planing boat 20 according to this embodiment, FIG. 2 is a plan view of the same, and FIG. 3 is a sectional view of the same.

In the small planing boat 1, a boat body 2 constituting a floating body structure is constructed by forming a space inside the boat by a hull 3 on the lower side forming the bottom of the boat, and a deck 4 on the upper side. An internal combustion engine 20 is accommodated in the space inside the boat body 2. One to three occupants sit in a saddle-riding manner on a seat 5 at the center of the deck 4 on the boat body 2. Steering is performed by operating a handlebar 6 located in front of the seat 5.

A jet propulsion pump 10 driven by the internal combustion engine 20 constitutes the propulsion means of the small planing boat 1. The jet propulsion pump 10 is arranged in a rear portion of the hull 3.

Figure 20:
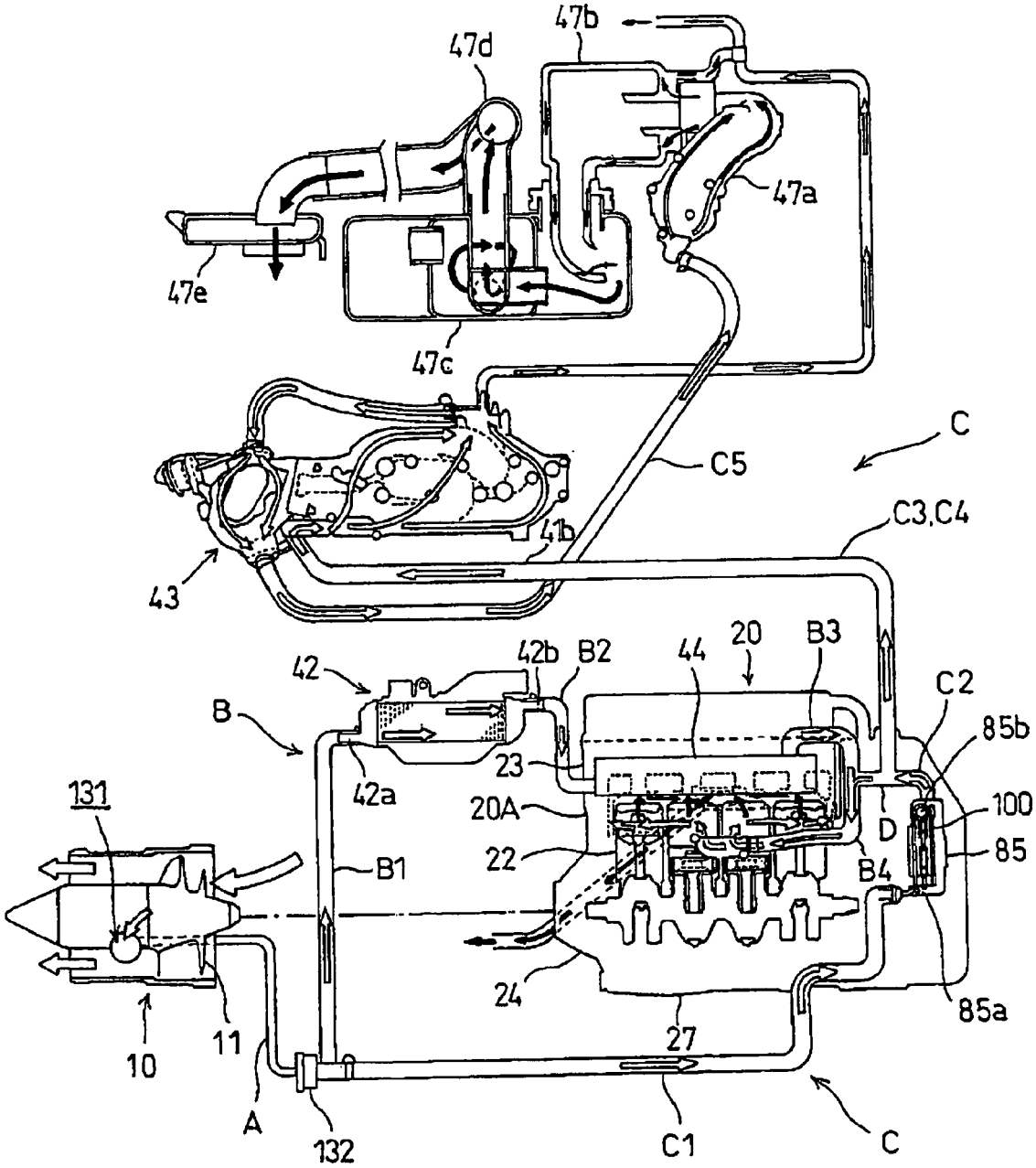
FIG. 20 is a view showing the circulation path of cooling water.

The jet propulsion pump 10 is an axial flow pump that is of a structure in which an impeller 11 is interposed in the flow passage extending from a water intake port 12 formed at the bottom of the boat to a nozzle 13 provided in a jet port formed at the rear end of the boat body, see FIG. 20. A shaft 15 of the impeller 11 is coupled to a crankshaft 21 of the internal combustion engine 20 via a joint 56.

Accordingly, when the impeller 11 is rotationally driven by the internal combustion engine 20 via the shaft 15, this causes the water sucked up from the water intake port 12 at the bottom of the boat to jet out from the jet port via the nozzle 13. The reaction at this time propels the boat body 2, allowing the small planing boat 1 to plane across the water.

The propulsion force by the jet propulsion pump 10 is controlled through operation of a throttle lever 7 attached to the handlebar 6. The nozzle 13 is rotated via an operating wire through the steering of the handlebar 6. The advancing direction is changed by changing the direction of the outlet of the nozzle 13.

The internal combustion engine 20 is arranged at substantially the center inside the boat body 2 and below the seat 5. The boat body 2 has an accommodating chamber 8 provided at the front portion thereof. A fuel tank 9 is provided between the accommodating chamber 8 and the internal combustion engine 20.

The internal combustion engine 20 is an inline 4-cylinder internal combustion engine of a DOHC 4-stroke cycle that is vertically placed inside the boat body 2 with the crankshaft 21 oriented in the longitudinal direction of the boat body 2.

Figure 8:
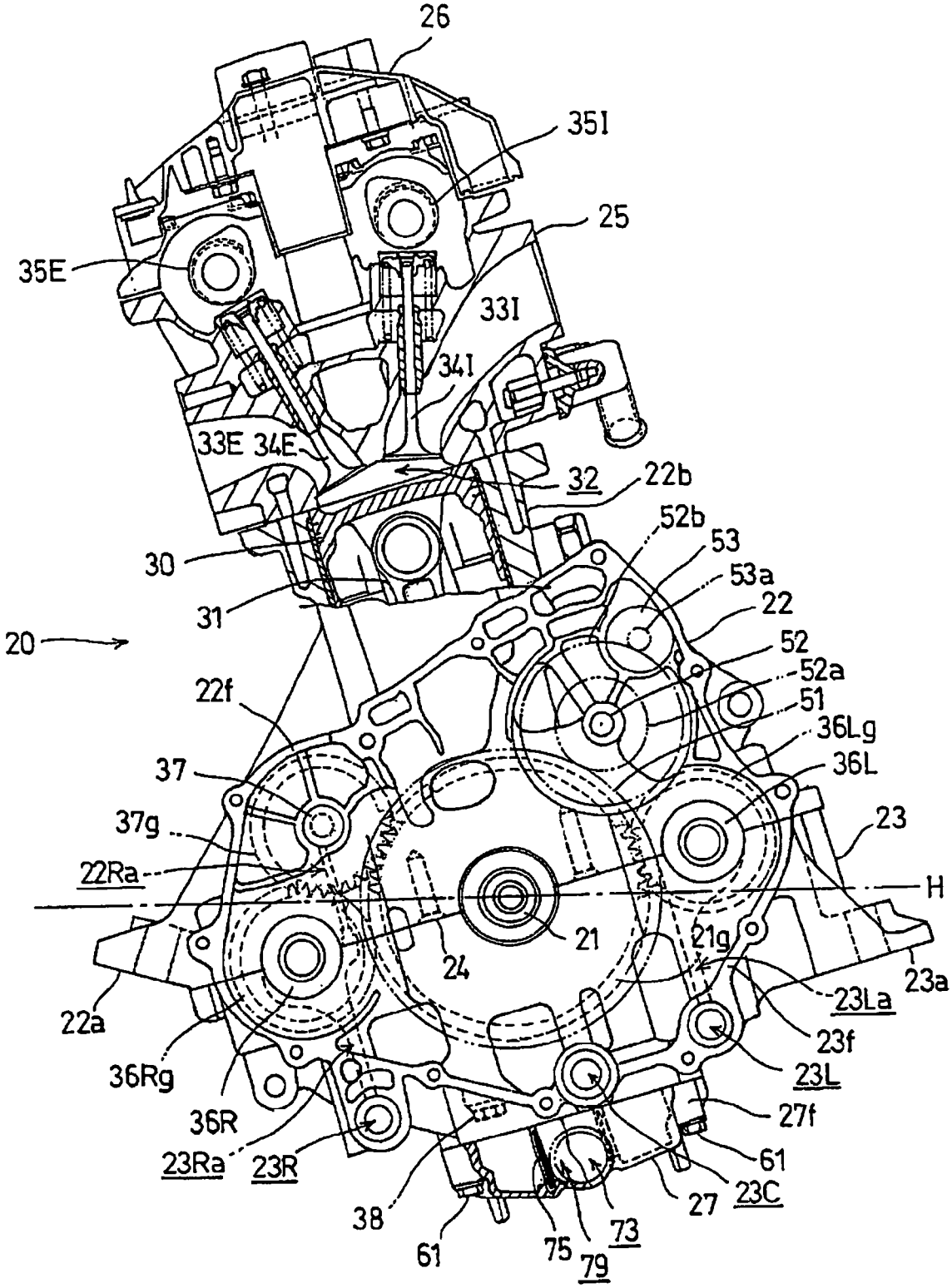
FIG. 8 is a front view, partially in section and partially omitted, of the internal combustion engine.

An internal combustion engine main body 20A is formed as follows. Referring to FIG. 8, a cylinder block 22 and a crankcase 23 that are split into upper and lower parts are joined together such that the crankshaft 21 is rotatably journalled on a parting surface 24. A cylinder head 25 is overlapped onto the cylinder block 22, and a cylinder head cover 26 is further placed over the cylinder block 22.

Further, an oil pan 27 is attached under the crankcase 23.

It should be noted that in this specification, the left and right directions are determined with reference to the advancing direction of the boat body.

Figure 11:
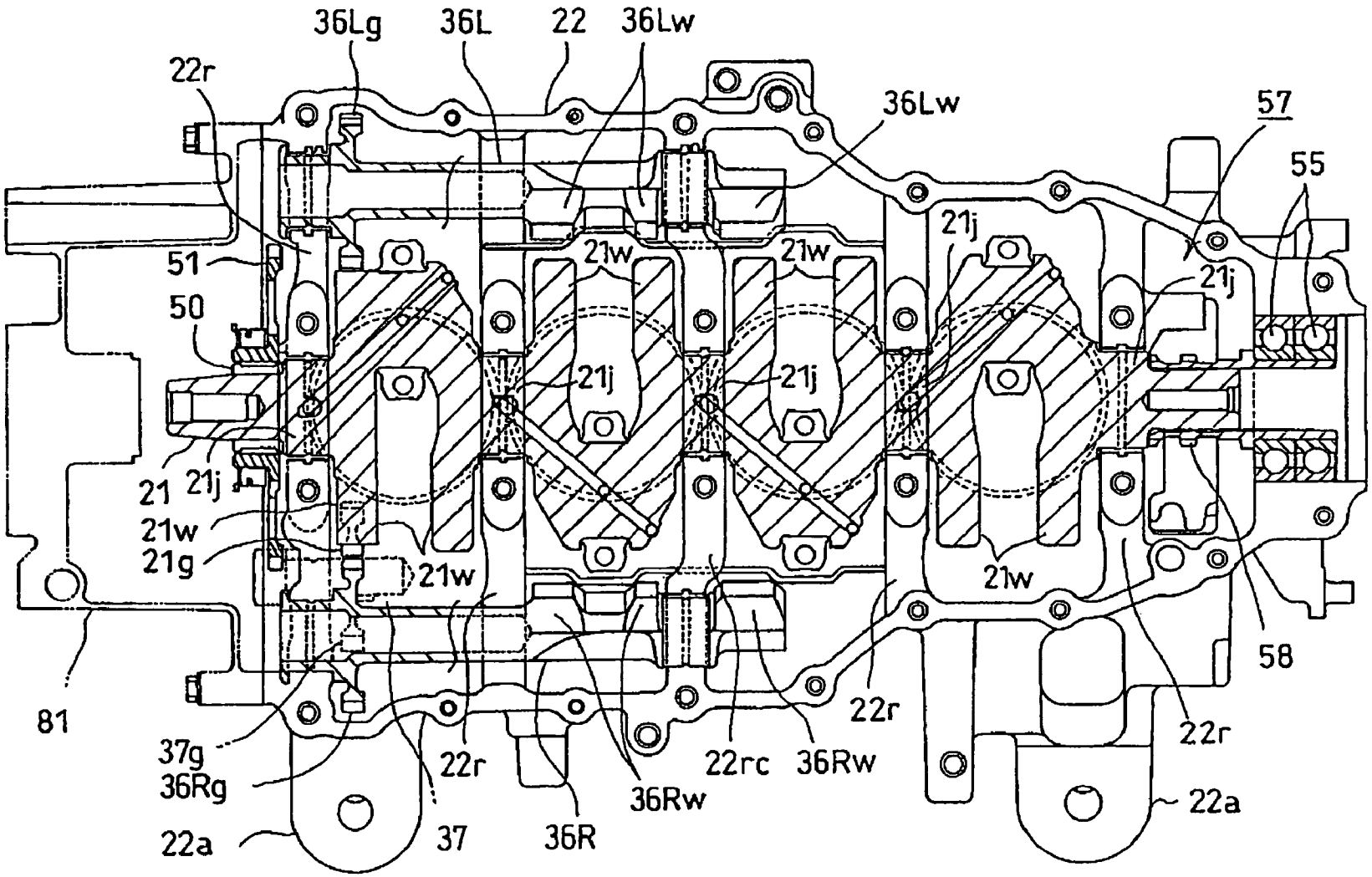
FIG. 11 is a sectional view of a crankshaft as seen from the bottom of a cylinder block.

Mount brackets 22*a*, 22*a* are provided at the front and rear of the lower end of the right-side surface of the cylinder block 22 so as to project diagonally upward, see FIGS. 8, 11. On the other hand, a pair of front and rear mount brackets 23*a*, 23*a* are provided to the crankcase 23 so as to project from the left-side surface in parallel to the parting surface 24, see FIGS. 8, 13.

Figure 4:
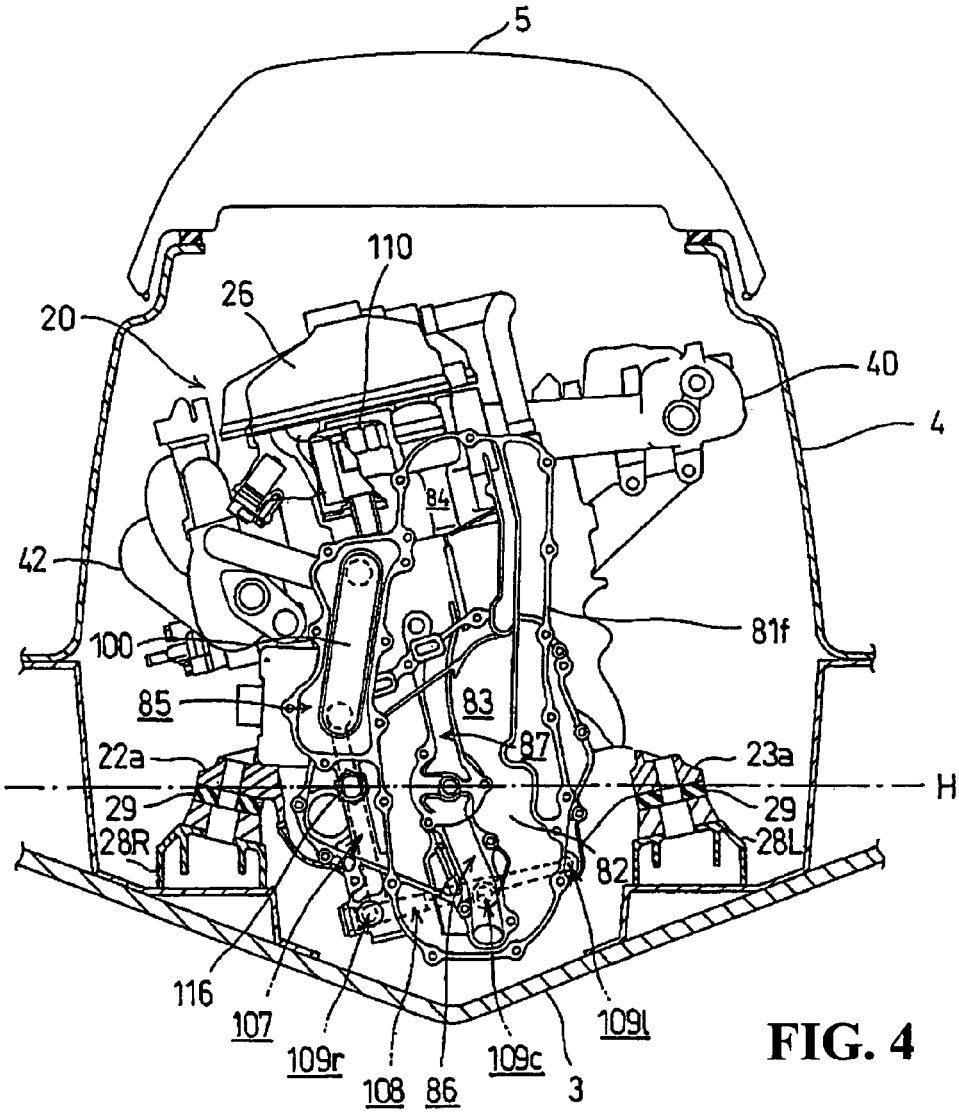
FIG. 4 is a front view, partially in section and partially omitted, of the boat body and internal combustion engine.

Accordingly, the mount brackets 22*a* and the mount brackets 23*a* that are provided so as to project on the left and right sides of the internal combustion engine main body 20A project at an obtuse angle relative to each other. As shown in FIG. 4, the mount brackets 22*a* and 23*a* are mounted at the same horizontal height via rubber isolator members 29, 29 to mountings 28L, 28R provided on the left and right sides of the hull 3 inside the boat body 2, whereby the internal combustion engine 20 is supported in a suspended manner.

Accordingly, the parting surface 24 between the cylinder block 22 and the crankcase 23 is parallel to the projecting direction of the left-side mount bracket 23*a*, and is hence inclined so as to be angled upwardly to the left with respect to the horizontal line H, see FIGS. 4, 8.

In the internal combustion engine main body 20A, a cylinder 22*b* of the cylinder block 22 is formed so as to extend perpendicularly to the parting surface 24. The cylinder head 25 and the cylinder head cover 26 are provided in the extending direction of the cylinder 22*b* with the oil pan 27 being also attached to the crankcase 23 in the direction perpendicular to the parting surface 24. Accordingly, as shown in FIG. 4 and FIG. 8, the internal combustion engine main body 20A is mounted to the boat body 2 so as to be generally tilted to the right side.

As shown in FIG. 8, a piston 30 reciprocates inside the cylinder 22*b* that is tilted to the right, and the crankshaft 21 is rotated via a connecting rod 31.

The cylinder head 25 overlapped on the cylinder 22*b* has a combustion chamber 32 formed so as to be opposed to the top surface of the piston 30. An intake port 33I and an exhaust port 33E are formed so as to extend to the left and right from openings formed in the combustion chamber 32.

Cam shafts 35I and 35E for respectively sliding an intake valve 34I for opening/closing the opening of the intake port 33I, and an exhaust valve 34E for opening/closing the opening of the exhaust port 33E, are provided at the position of the joining surface between the cylinder hear 25 and the cylinder head cover 26.

On the left side of the internal combustion engine main body 20A, an intake manifold 40 that communicates with the intake port 331 is connected and arranged so as to project. An exhaust manifold 44 that communicates with the exhaust port 33E is connected on the right side of the internal combustion engine 20, see FIGS. 4, 5.

Figure 5:
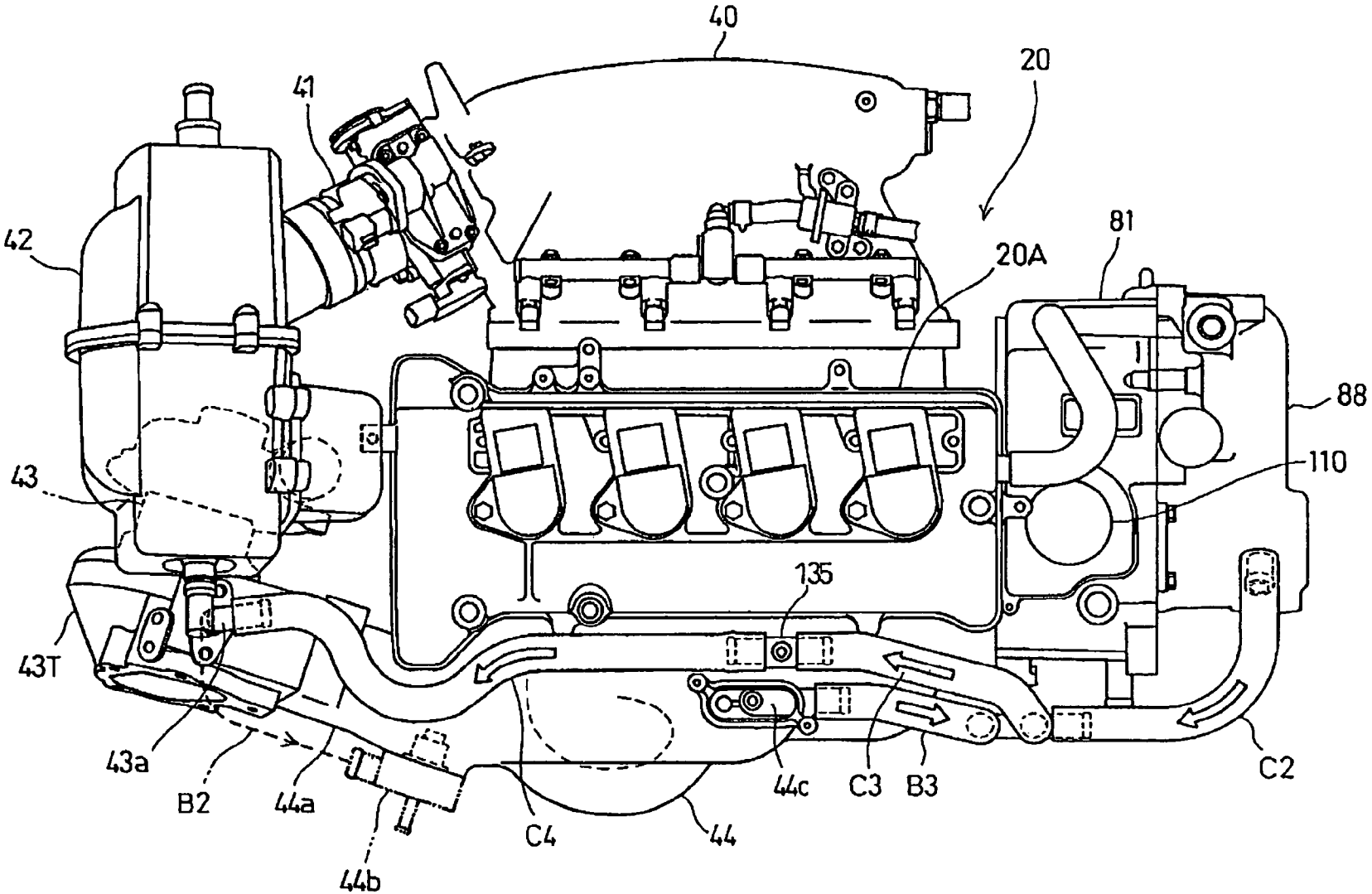
FIG. 5 is a top view of the internal combustion engine.
Figure 6:
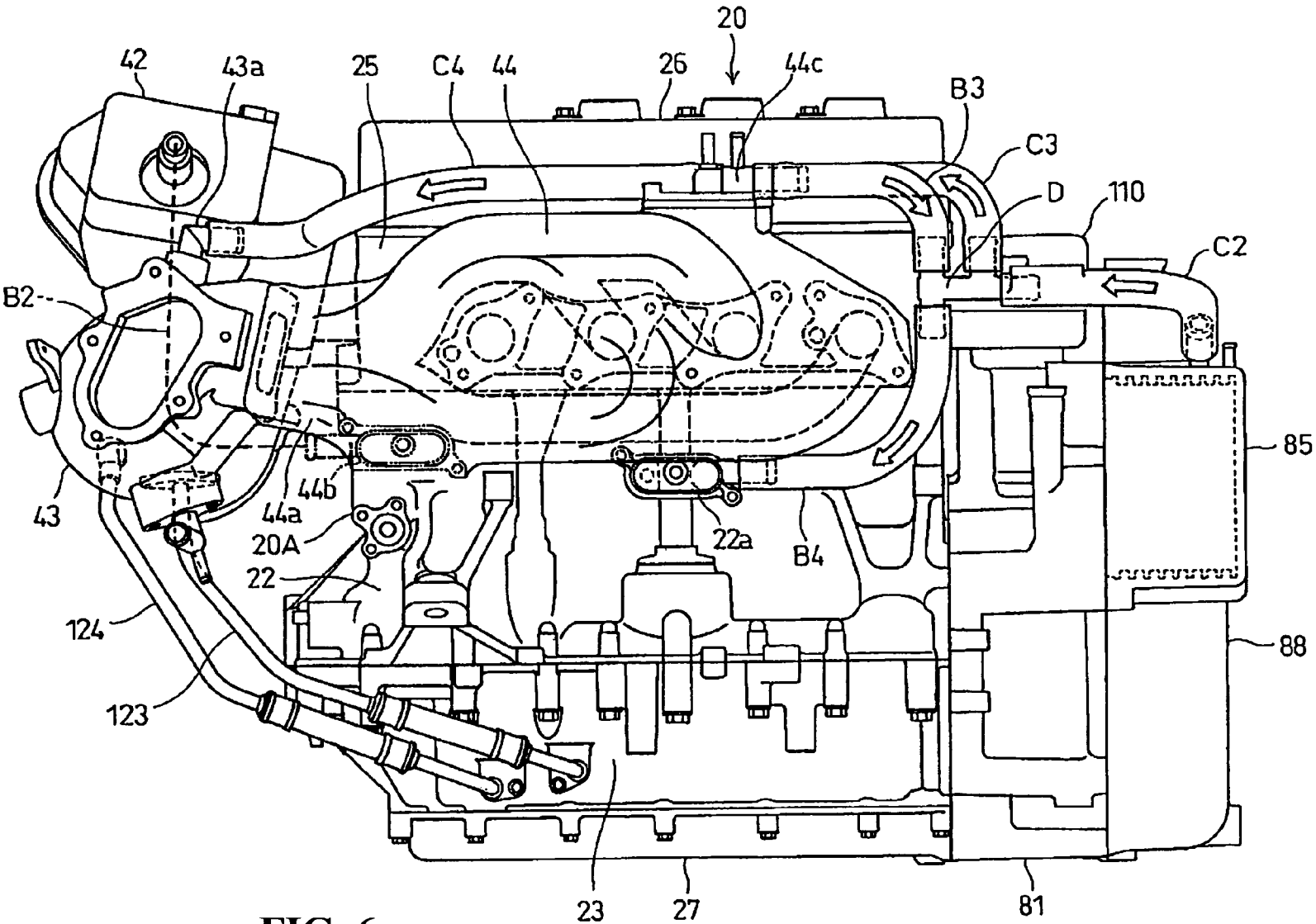
FIG. 6 is a left-side view of the internal combustion engine.
Figure 7:
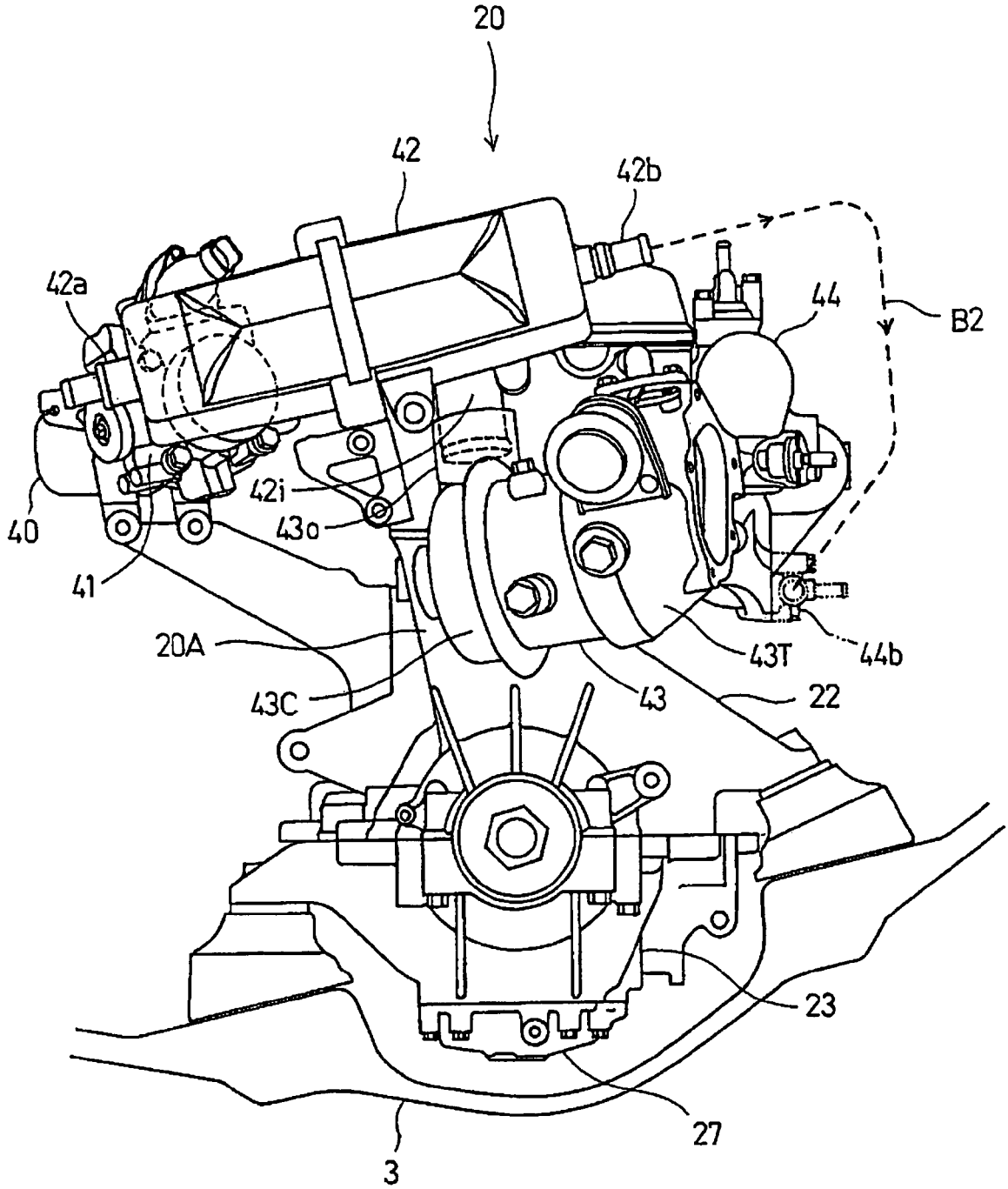
FIG. 7 is a rear view of the internal combustion engine.

A turbo-charger 43 and an intercooler 42 for cooling the intake air pressurized by the turbo-charger 43 are disposed to the rear of the internal combustion engine main body 20A, see FIGS. 5, 6 and 7.

It should be noted that the turbo-charger 43 may be a supercharger.

As shown in FIG. 6, the intercooler 42 is positioned at the height of the joining surface between the cylinder head 25 and the cylinder head cover 26. The turbo-charger 43 is positioned at the height of the joining surface between the cylinder head 25 and the crankcase 23. The turbo-charger 43 is disposed directly below and in close proximity to the intercooler 42.

The intake manifold 40 is provided to the left-side surface of the internal combustion engine main body 20A so as to project at substantially the same height as the intercooler 42. The intake manifold 40 and the intercooler 42 that is disposed to the rear of the internal combustion engine main body 20A are coupled to each other by a throttle body 41.

As shown in FIG. 5, the intake manifold 40, consisting of a collection of intake pipes leading to respective cylinders, is bent rearwardly along the left-side surface of the internal combustion engine main body 20A and is connected to the throttle body 41 that is common to the respective cylinders. The throttle body 41 is connected to the intercooler 42 while being oriented diagonally so as to wrap around to the rear of the internal combustion engine main body 20A.

Since the throttle body 41 is disposed so as to wrap around to the rear of the internal combustion engine main body 20A and thus approaches the intercooler 42 located in rear of the internal combustion engine main body 20A, the throttle body 41 is directly connected to the intercooler 42 without the use of additional piping.

As shown in FIG. 5, the intake manifold 40 is curved such that its port-side outer edge comes closer to the center of the internal combustion engine main body 20A as it extends toward the rear-end side. The intake path extending from the intercooler 42 to the intake manifold 40 via the throttle body 41 is thus curved gently along the portion of the internal combustion engine main body 20A from the rear surface to the left-side surface.

The intercooler 42, the throttle body 41, and the intake manifold 40 are disposed in a concentrated fashion along the portion of the internal combustion engine main body 20A from the rear surface to the left-side surface. Further, the throttle body 41 is disposed so as to wrap around to the rear of the internal combustion engine main body 20A, thereby reducing the lateral width of the portion in rear of the internal combustion engine main body 20A.

Further, since the throttle body 41 is disposed so as to wrap around to the rear of the internal combustion engine main body 20A and hence comes closer to the intercooler 42 located in rear of the internal combustion engine main body 20A, the throttle body 41 can be directly connected to the intercooler 42 to thereby reduce piping and the like.

A turbine portion 43T of the turbo-charger 43 arranged directly below the intercooler 42 is connected to an exhaust lead-out passage 44*a* of the exhaust manifold 44, and a compressor portion 43C thereof is connected to the intercooler 42 above the turbo-charger 43.

More specifically, since the turbo-charger 43 is arranged directly below the intercooler 42, as shown in FIG. 7, a connecting pipe 421 extending downwardly from the intercooler 42 is directly connected to a connecting pipe 43*o* extending upwardly from the compressor portion 43C.

Accordingly, no special piping for connection is required.

In this way, the intake path leading to the intake manifold 40 from the turbo-charger 43 via the intercooler 42 is curved gently and formed in an efficient manner so that the distance of the intake path becomes the shortest, and hence the intake resistance becomes the smallest to achieve an improvement in intake efficiency.

On the other hand, the exhaust path of the internal combustion engine 20 leads to the turbine portion 43T of the turbo-charger 43 from the exhaust manifold 44 via the exhaust lead-out passage 44*a*. As shown in FIGS. 1 and 2, and also with reference to FIG. 20, the exhaust that has rotated a turbine wheel in the turbine portion 43T sequentially passes through an exhaust pipe 47*a*, a backflow prevention chamber 47*b* (chamber for preventing backflow of water so that water does not enter the turbo-charger or the like in the event the boat capsizes), a water muffler 47*c*, and a piping 47*d* to reach a water chamber 47*e* leading into the water to be discharged into the water.

As described above, the crankshaft 21 is rotatably journalled to respective bearings of the parting surface 24 between the cylinder block 22 and the crankcase 23. Two balancer shafts 36L, 36R for canceling secondary vibration are rotatably journalled to the bearings on the left and right sides of the crankshaft 21.

A total of five crank journals 21*j*, including three crank journals 21*j* between four crank web 21*w* pairs corresponding to the four cylinders of the crankshaft 21, and two crank journals 21*j* at the front and at the rear, are rotatably journalled by being held between semi-arcuate bearings, which are formed in five ribs 22*r*, 23*r* respectively formed on both upper and lower sides of the cylinder block 22 and crankcase 23 and constituting vertical walls in the longitudinal direction, via metal bearings.

Figure 9:
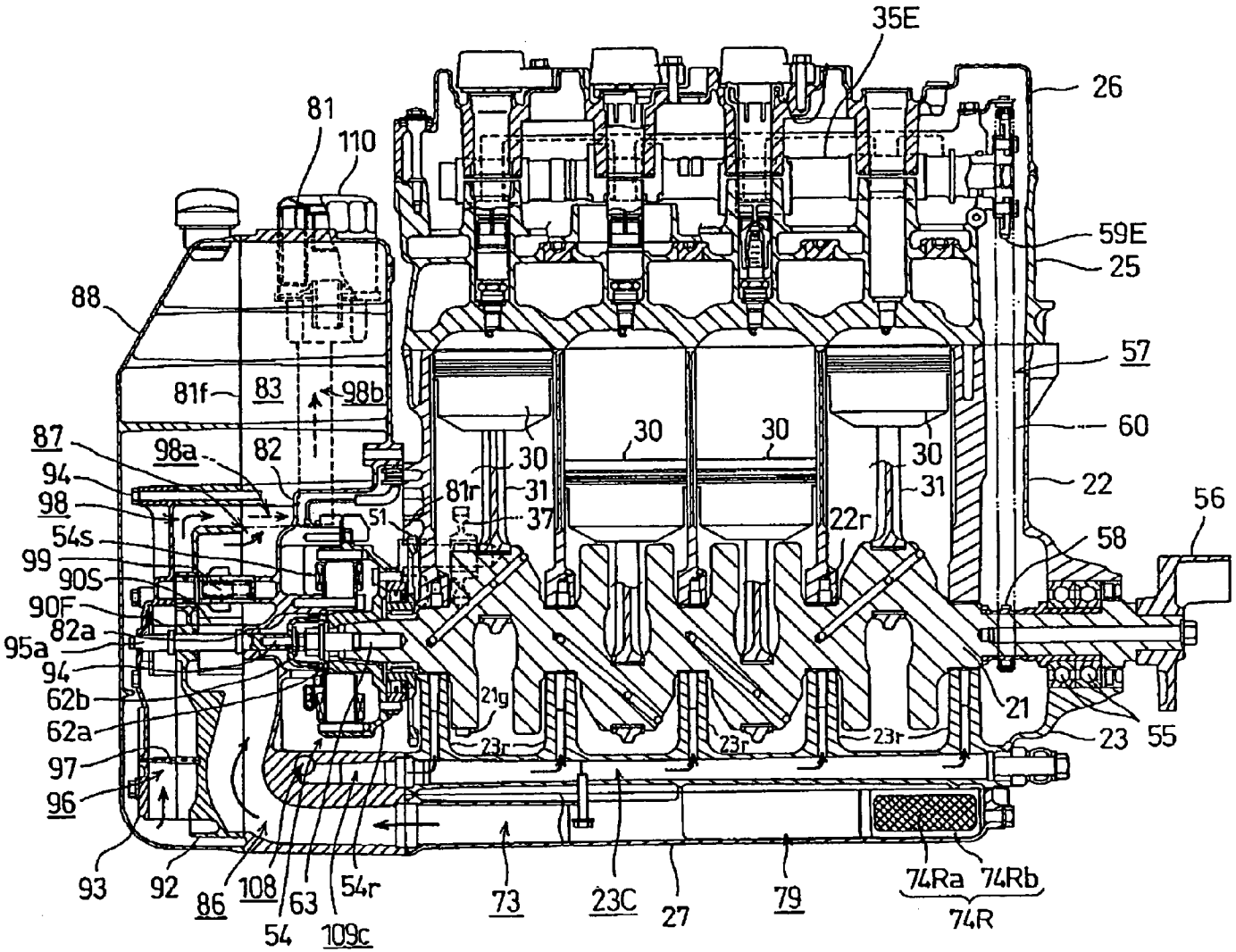
FIG. 9 is a side sectional view of the internal combustion engine.

As shown in the bottom view of the cylinder block 22 in FIG. 9, of the five ribs 22*r* on which the crankshaft 21 is journalled by means of their bearings, four ribs 22*r* excluding a rib 22*rc* at the center are flat without being bent all the way to the left and right ends thereof. On the other hand, the left and right end portions of the rib 22*rc* at the center are bent so as to be offset forward (to the left as seen in FIG. 9) with respect to the bearing portion to which the crankshaft 21 is journalled.

Rear-side bearing portions of the balancer shafts 36L, 36R are provided in the left and right portions of the central rib 22*rc* which are thus offset forward, and front-side bearing portions of the balancer shafts 36L, 36R are provided in the left and right portions of the rib 22*r* that forms the outer wall on the foremost side.

More specifically, the balancer shafts 36L, 36R are arranged side by side in parallel on the left and right sides of the crankshaft 21, and have their front and rear portions rotatably journalled to the bearing of the rib 22*r* on the foremost side and the bearing of the rib 22*rc* at the center, respectively, via metal bearings. The balancer shafts 36L, 36R are thus disposed so as to be offset toward the front side of the cylinder block 22.

Further, the balancer shafts 36L, 36R have their balance weights divided by the central rib 22*rc*. The balancer shafts 36L, 36R have balance weights 36Lw, 36Rw located between the center rib 22*rc* and a rib 25*r* adjacent to and in front of the center rib 22*rc*, and include balance weights 36Lw, 36Rw that project rearwardly in a cantilevered fashion from the center rib 22*rc*.

The lateral width of the cylinder block 22 is large on the front side where the balancer shafts 36L, 36R are disposed, and is small on the rear side where no balancer shafts 36L, 36R are disposed.

As shown in FIGS. 9 and 11, a drive gear 21*g* is formed in the outer periphery of the crank web 21*w* of the crankshaft 21 which rotates along each of the inner surfaces of the ribs 22*r*, 23*r* constituting the foremost outer walls of the cylinder block 22 and crankcase 23.

On the other hand, the balancer shafts 36L, 36R also have driven gears 36Lg, 36Rg formed along the inner surfaces of the ribs 22*r*, 23*r* constituting the foremost outer walls.

Further, the driven gear 36Lg of the left-side balancer shaft 36L and the drive gear 21*g* in the outer periphery of the crank web 21*w* of the crankshaft 21 directly mesh with each other.

On the other hand, as shown in FIG. 8, at a position diagonally upward to the left from the driven gear 36Rg of the right-side balancer shaft 36R, an intermediate shaft 37 is supported on the rib 22*r* of the cylinder block 22, and an intermediate gear 37*g* rotatably journalled to the intermediate shaft 37 meshes with the driven gear 36Rg of the right-side balancer shaft 36R and, at the same time, also meshes with the drive gear 21*g* in the outer periphery of the crank web 21*w* of the crankshaft 21.

Accordingly, as the crankshaft 21 rotates, the left and right balancer shafts 36L, 36R rotate in opposite directions, and act to cancel secondary vibrations by rotating at twice the rotational speed of the crankshaft 21.

The gear mechanisms formed by the drive gear 21*g*, the intermediate gear 37*g*, and the driven gears 36Lg, 36Rg for transmitting the rotation of the crankshaft 21 to the left and right balancer shafts 36L, 36R are disposed inside the cylinder block 22 and the crankcase 23 along the inner surfaces of the ribs 22*r*, 23*r* constituting the foremost outer walls, and are located at positions that are the same as and overlapping those of the mount brackets 22*a*, 23*a* of the cylinder block 22 and crankcase 23 with respect to the longitudinal direction as seen in side view.

Accordingly, a sufficiently high rigidity can be secured for portions in the periphery of the gear mechanisms for transmitting rotary power and for the bearing portions of the balancer shafts 36L, 36R in the cylinder block 22 and the crankcase 23, without the provision of an additional special structure.

As shown in FIG. 11, at the portion of the crankshaft 21 projecting outwardly from the ribs 22*r*, 23*r* constituting the outer walls of the cylinder block 22 and crankcase 23, a starter driven gear 51 is provided along each of the outer surfaces of the ribs 22*r*, 23*r* via a one-way clutch 50, and further, an outer rotor 54*r* of an AC generator 54 is attached in front of the starter driven gear 51, see FIG. 9.

As indicated by the two-dot chain line in FIG. 8, a small diameter gear 52*s* rotatably supported on a reduction gear shaft 52 meshes with the starter driven gear 51, and a large-diameter gear 52*b* that is integral with the small-diameter gear 52*a* meshes with a drive gear 53*a* fitted onto the drive shaft of a starter motor 53 located above the left-side balancer shaft 36L.

On the other hand, as shown in FIG. 9, the rear portion of the crankshaft 21 projects rearwardly while being journalled via bearings 55 to the bearing portion in the rear wall of each of the cylinder block 22 and crankcase 23. This rear end portion is coupled via the joint 56 to the shaft 15 connected to the impeller 11 of the above-mentioned jet propulsion pump 10.

Referring to FIG. 9, a cam chain chamber 57 is formed between the rear walls of the cylinder block 22 and crankcase 23 and the ribs 22*r*, 23*r* on the rearmost side. In the cam chain chamber 57, a drive sprocket 58 is fitted onto the crankshaft 21, and as shown in FIG. 12, a cam chain 60 is suspended between the drive sprocket 58 and driven sprockets 59I, 59E fitted onto the rear end portions of the above-mentioned cam shafts 351, 35E that are located above.

In the cam chain chamber 57, left and right cam chain guides 65, 66 are provided along the cam chain 60 from the cylinder head 25 to the cylinder block 22.

Figure 12:
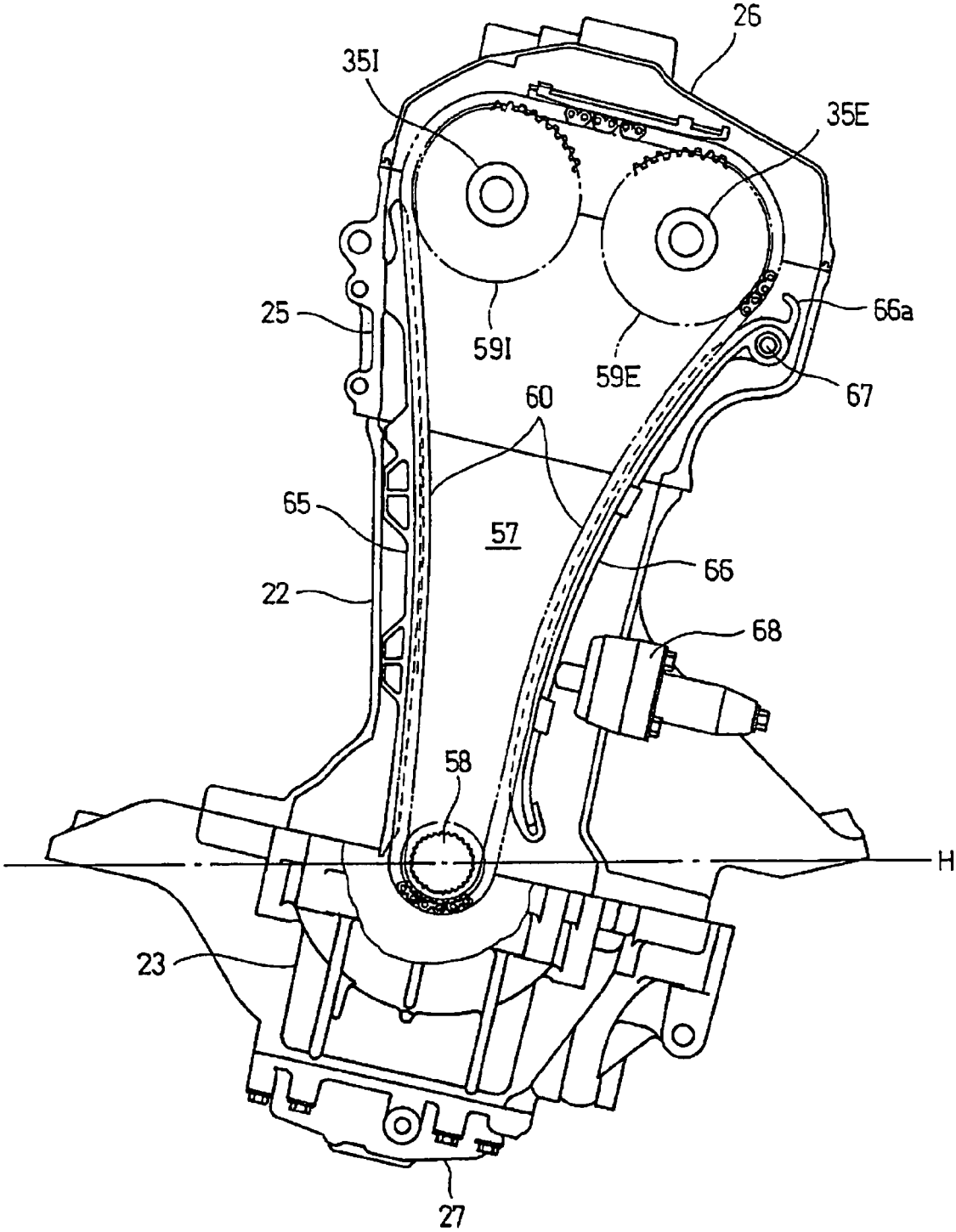
FIG. 12 is a rear view showing the interior of a cam chain chamber.

The upper end of the cam chain guide 66 on the starboard side is rockably journalled to a support shaft 67 provided so as to project from the cylinder head 25, and a lower part of the cam chain guide 66 is urged by a cam chain tensioner 68 attached to the cylinder block 22 so as to hold down the cam chain 60 and impart an appropriate tension, see FIG. 12.

To attach the cam chain guide 66, the cam chain guide 66 is inserted from the upper end opening of the cam chain chamber 57 in the cylinder head 25, and the journalling portion at the upper end of the cam chain guide 66 is journalled to the support shaft 67. However, since the support shaft 67 is located at some depth from the upper end opening of the cam chain chamber 57, the operation of journalling the journalling portion at the upper end of the cam chain guide 66 to the support shaft 67 is not easy.

In view of this, the cam chain guide 66 has a knob portion 66*a* that extends upwardly from the upper end and is bent. The knob portion 66*a* is pinched, thereby facilitating the operation of journalling the journaling portion at the upper end of the cam chain guide 66 to the support shaft 67.

It should be noted that the detachment of the cam chain guide 66 is also facilitated due to the provision of the knob portion 66*a* to the cam chain guide 66.

Figure 13:
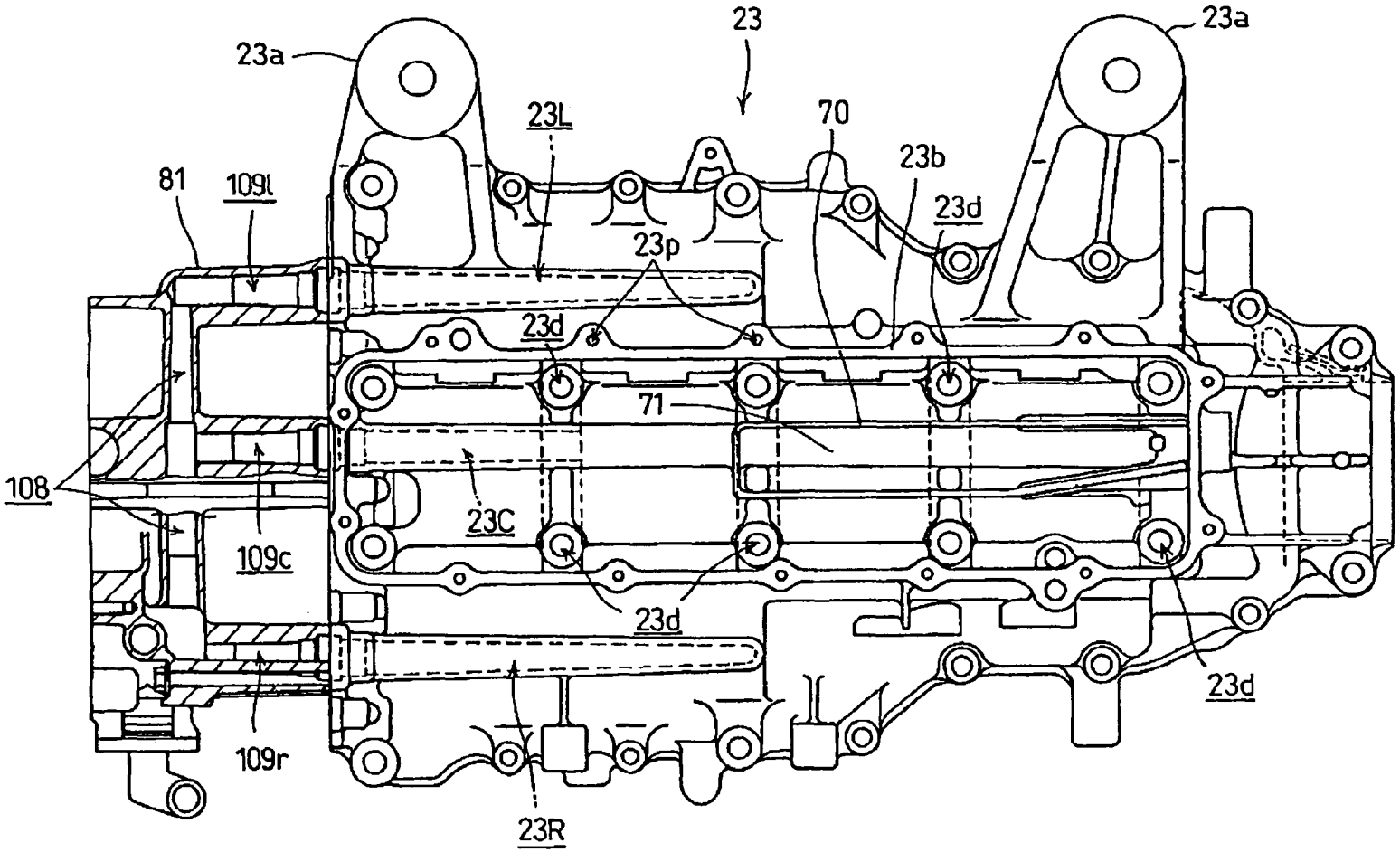
FIG. 13 is a bottom view of a crankcase.

As shown in FIG. 13, an elongated rectangular opening is provided in the longitudinal direction in the lower surface of the crankcase 23, and a mating surface 23*b* is formed in the edge of that opening. The oil pan 27 is attached from below in conformity with the mating surface 23*b*.

Figure 14:
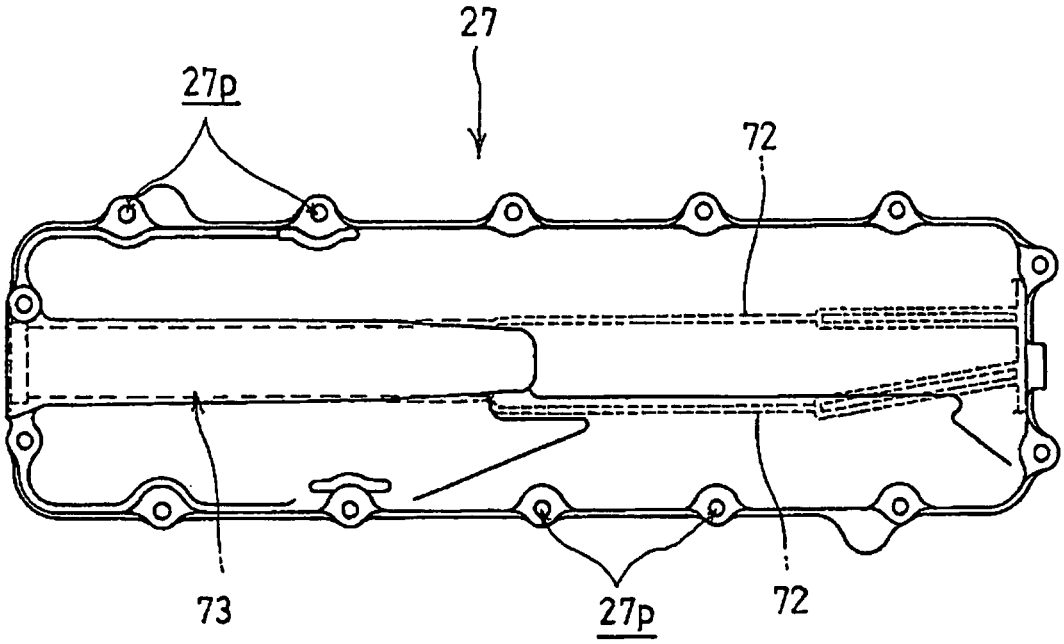
FIG. 14 is a bottom view of an oil pan.
Figure 15:
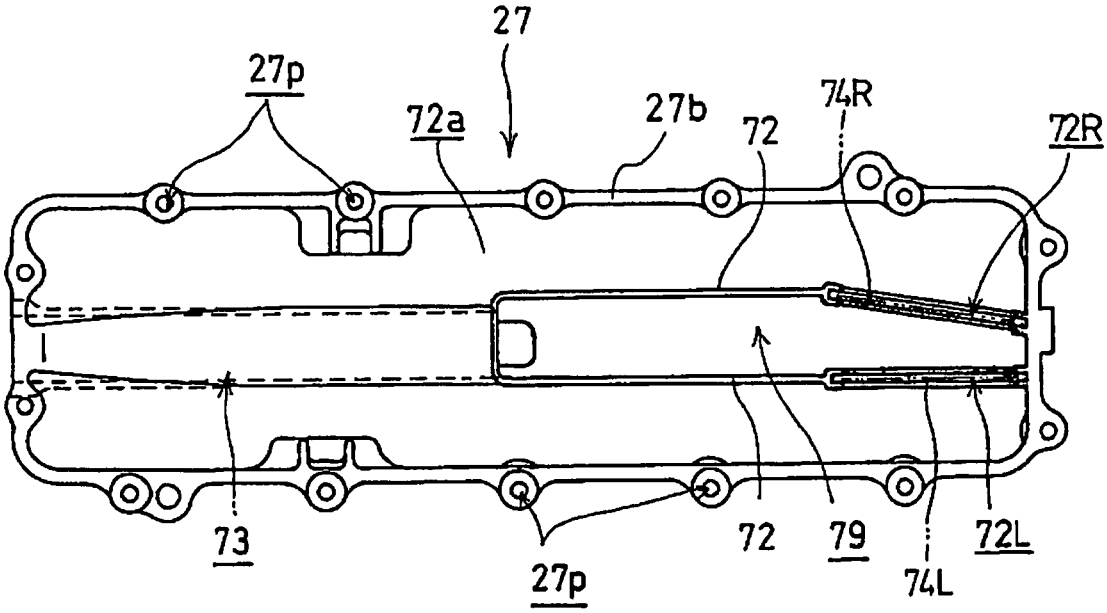
FIG. 15 is a top view of the oil pan.

Screw holes 23*p* are formed in the rectangular mating surface 23*b*. As shown in FIGS. 14 and 15, bolts 61 are inserted through mounting holes 27*p*, which are formed in a rectangular edge mating surface 27*b* of the oil pan 27, and threaded into the screw holes 23*p*, thereby attaching the oil pan 27 to the crankcase 23.

Referring to FIG. 13, a main oil passage 23C extends through the crankcase 23 in the longitudinal direction along the lower surface of the crankcase 23 and opens in the front wall of the crankcase 23. Bolt holes 23*d* are formed on the left and right of the five ribs 23*r* across the oil passage 23C. Fastening bolts 38 penetrating the bolt holes 23*d* are threaded into the cylinder block 22, thereby fastening and coupling the crankcase 23 and the cylinder block 22 together, see FIG. 8.

It should be noted that left- and right-balancer oil passages 23L, 23R for supplying oil to the bearings of the left and right balancer shafts 36L, 36R are provided on the left and right of the main oil passage 23C so as to be parallel to the main oil passage 23C. The left- and right-balancer oil passages 23L, 23R both open in the front wall of the crankcase 23, see FIG. 8.

Further, within the rectangular mating surface 23*b* of the crankcase 23, a frame wall 70 in the shape of an elongated rectangle is formed in the longitudinal direction in the rear half portion. The frame wall 70 is formed by a total of four sides consisting of the three sides including the front, left, and right side, and the rear side constituted by the wall of the mating surface 23*b*. The portion inside the frame wall 70 has a raised bottom surface 71 and is downwardly open, see FIG. 13.

The lower end face of the frame wall 70 is flush with the mating surface 23*b* of the oil pan 27.

On the other hand, as shown in FIGS. 14 and 15, inside the oil pan 27, a frame wall 72, which forms an oil passage in correspondence with side walls excluding the rear portions of the left and right sides of the frame wall 70 of the crankcase 23, is erected from the bottom surface.

An oil recovery passage 73 is provided so as to extend straight forward with a circular opening formed in the front-side wall of the frame wall 72. The oil recovery passage 73 opens in the front wall of the oil pan 27, see FIG. 8 and communicates with an oil pump 90 that will be described later.

Referring to FIG. 15, the rear portion of each of the left-side wall and right-side wall of the flame wall 72 that is a vertical wall is cut away in a U shape to form a communication opening. Grooves 72L, 72R are each formed in the respective inner edge portions of the three sides of the communication opening.

It should be noted that while the communication opening of the left-side wall is perpendicular to the lateral direction, as for the communication opening of the right-side wall, the rear portion of the right-side wall is bent toward the center so as to be closer to the center side as it extends rearwardly.

Accordingly, as seen in the top view of FIG. 15, the groove 72L of the communication opening of the left-side wall and the groove 72R of the communication opening of the right-side wall are formed in a substantially V-shape such that they approach each other as they extend rearwardly.

Horizontally elongated, rectangular oil strainers 74L, 74R are fitted in the grooves 72L, 72R in a substantially vertical position. Thus, the oil strainers 74L, 74R are also arranged in a substantially V-shape.

Figure 16:
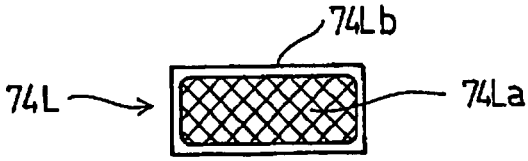
FIG. 16 is a side view of an oil strainer.

The side view of the oil strainer 74L is shown in FIG. 16.

A rubber member 74Lb is provided around the frame in the edge portion of a rectangular oil screen 74La corresponding to the communication opening in the left-side wall of the frame wall 72.

Although the other oil strainer 74R is of the same structure in which a rubber member 74Rb is provided around the frame in the edge portion of a rectangular oil screen 74Ra corresponding to the communication opening in the right-side wall of the frame wall 72, see FIG. 9, the oil strainer 74R is longer since its rear portion is inclined toward the center, and the oil screen 74Ra has a larger surface area.

When the oil pan 27 is attached to the crankcase 23 in the state where the oil strainers 74L, 74R are respectively fitted in the grooves 72L, 72R of the respective communication openings of the frame wall 72, the end face of the frame wall 70 on the crankcase 23 side and the end face of the frame wall 72 on the oil pan 27 side are brought to face each other, and the rubber members 74Lb, 74Rb at the upper ends of the oil strainers 74L, 74R abut on the left-side wall and right-side wall of the frame wall 70, so the space inside the oil pan 27 is partitioned off by the frame walls 70, 72, the raised bottom surface 71, the oil pan bottom surface, and the oil strainers 74L, 74R, and a cavity 79 constituting an oil passage of a rectangular parallelepiped shape is formed.

The cavity 79 communicates with the oil recovery passage 73 from the opening in the front-side wall of the frame wall 72.

Accordingly, oil that has accumulated in the oil pan 27 passes through the oil screens 74La, 74Ra of the oil strainers 74L, 74R and flows into the cavity 79 before entering the oil recovery passage 73.

Since the oil strainers 74L, 74R are placed vertically in the oil pan 27, as compared with the case of a horizontal placement, the lateral width of the oil pan 27 can be reduced, thereby facilitating conformity to the configuration of the hull 3 at the center of the bottom of the small planing boat sloping laterally upwardly. Further, a sufficient space can be provided on the left and right of the oil strainer even when the vertical width of the oil pan is made small, thereby making it possible to make the vertical width of the oil pan itself small. Thus, the total height of the internal combustion engine is lowered.

Further, since the oil strainers 74L, 74R are arranged in a substantially V-shape in the rear portion of the oil pan 27, oil that has gathered in the rear portion of the oil pan 27 at the time of acceleration can be readily filtered, and the oil strainers 74L, 74R themselves can be reduced in size.

Further, the flow of oil that lubricates respective portions of the cylinder head 25 and drops through the can chain chamber 57 is not hindered and can be returned to the oil pan 27.

The cavity 79 partitioned off by the oil strainers 74L, 74R is defined by the frame wall 70 formed in the crankcase 23 and the raised bottom surface 71 and by the frame wall 72 formed in the oil pan 27 and the oil pan bottom surface. Accordingly, no special dedicated part is required, thereby making it possible to achieve a reduction in the number of parts.

Further, the structure in which the oil strainers 74L, 74R are held between the crankcase 23 and the oil pan 27 contributes to the ease of assembly.

Coplanar mating surfaces 22*f*, 23*f* and 27*f* are formed in the front surfaces of the cylinder block 22, crankcase 23, and oil pan 27 described above, see FIG. 8. A tank body 81 of an oil tank 80 is joined to the mating surfaces 22*f*, 23*f* and 27*f*.

It should be noted that the oil tank 80 is formed by the tank body 81 and a tank cover 88 covered over the front surface of the tank body 81.

As shown in FIGS. 4 and 9, the tank body 81 has parallel mating surfaces, that is, a mating surface 81*r*, which is joined to the mating surfaces 22*f*, 23*f* and 27*f* in the front surfaces of the cylinder block 22, crankcase 23, and oil pan 27, and a mating surface 81*f* with the tank cover 88. An ACG cover portion 82 that covers the AC generator 54 and the reduction gears 52*a* and 52*b* is formed so as to bulge forward from the mating surface 81*r*. A generally vertically elongated oil accommodating portion 83 is formed in the space from above the ACG cover portion 82 to the left and right sides thereof. Further, a water-cooling type oil-cooler accommodating portion 85 is formed on the right side of the oil accommodating portion 83 and at a position higher than the crankshaft 21 so as to partially jut out.

It should be noted that FIG. 4 is a front view showing a state in which the tank body 81 is attached to the front surfaces of the cylinder block 22, crankcase 23, and oil pan 27.

A breather chamber 84 is provided in the space above the oil accommodating portion 83.

As shown in FIG. 9, the outer rotor 54*r* of the above-mentioned AV generator 54 is secured to the distal end portion of the crankshaft 21 by means of a bolt 63 together with a coupling 62*a*.

The coupling 62*a* is coupled to a coupling 62*b* at the rear end of a pump shaft 95 of the oil pump 90 that will be described later.

A coupling cover portion 82*a* that covers the couplings 62*a*, 62*b* is formed at the center of the ACG cover potion 82 so as to project rearwardly. An inner stator 54*s* of the AC generator 54 is supported in position while being fixed to the coupling cover portion 82*a*.

The oil pump 90 is provided in front of the ACG cover portion 82 that covers the AC generator 54 from the front.

The oil pump 90 has a first case 92 that is joined to the above-mentioned tank body 81 from the front, and a second case 93 that is joined from the front to be attached to the tank body 81 together with the first case 92 by means of a bolt 94. The pump shaft 95 extends through the front and rear cases, that is, the first and second cases 92 and 93, coaxially with the crankshaft 21 extending through the ACG cover portion 82. The above-mentioned coupling 62*b* is secured from the rear to the rear end of the pump shaft 95 by means of a bolt 95*a*.

A scavenging pump 90S is provided by fitting an inner rotor onto a shank of the pump shaft 92 in the first case 95, and a feed pump 90F is provided by fitting an inner rotor onto a shank of the pump shaft 95 in the second case 93.

Accordingly, the rotation of the crankshaft 21 is transmitted via the couplings 62*a*, 62*b* to the rotation of the pump shaft 95 so that the scavenging pump 90S and the feed pump 90F are driven.

Referring to FIGS. 4 and 9, an oil recovery passage 86 connected to the oil recovery passage 73 of the oil pan 27 is formed in a lower portion of the tank body 81. Apart of the oil recovery passage 86 is formed in the rear surface of the first case 92, and the oil recovery passage 86 extends upwardly to reach the scavenging pump 90S.

Accordingly, as the scavenging pump 90S is driven, lubricating oil that has accumulated in the oil pan 27 passes through the oil strainers 74L, 74R to be sucked in forward through the oil recovery passage 73, and passes through the oil recovery passage 86 to reach the scavenging pump 90S located above.

Referring to FIG. 9, a common recovered-oil discharge passage 87 is formed above the scavenging pump 90S by the rear surface of the first case 92 and the front surface of the tank body 81. The upper end of the recovered-oil discharge passage 87 opens in the oil accommodating portion 83 of the oil tank 80. Recovered-oil discharged by driving of the scavenging pump 90S is recovered into the oil accommodating portion 83 of the oil tank 80 passing through the recovered-oil discharge passage 87.

Further, as shown in FIG. 9, a supply-oil intake passage 96 is formed below the feed pump 90F by the front surface of the first case 92 and the rear surface of the second case 93, and also a supply-oil discharge passage 98 is formed above the feed pump 90F.

The lower end of the supply-oil intake passage 96 is open at a height close to the bottom surface of the oil accommodating portion 83, and the upper end of the supply-oil intake passage 96 communicates with the suction port of the feed pump 90F. A screen oil filter 97 is interposed in the supply-oil intake passage 96.

After extending upward from the discharge port of the feed pump 90F, the supply-oil discharge passage 98 is bent rearwardly and connected to a horizontal hole 98*a* formed in the tank body 81.

The horizontal hole 98*a* communicates with a vertical hole 98*b* also formed in the tank body 81 and is directed upwardly. The upper end of the vertical hole 98*b* opens in an annular shape in the mounting surface of an oil filter 110 that will be described later, and communicates with an oil inlet 111 of the oil filter 110, see FIG. 10.

Accordingly, when the feed pump 90F is driven, lubricating oil is sucked upward from a lower portion of the oil accommodating portion 83 of the oil tank 80 by way of the supply-oil intake passage 96 to be discharged to the supply-oil discharge passage 98. The lubricating oil is then pressure-fed upward through the horizontal hole 98*a* and the vertical hole 98*b* formed in the tank body 81 to reach the oil filter 110.

It should be noted that a relief valve 99 is interposed in the supply-oil discharge passage 98 between the supply-oil discharge passage 98 and the oil accommodating portion 83. When the discharge pressure of the oil being supplied is too high, the relief valve 99 causes excess oil to be returned to the oil accommodating portion 83.

Figure 10:
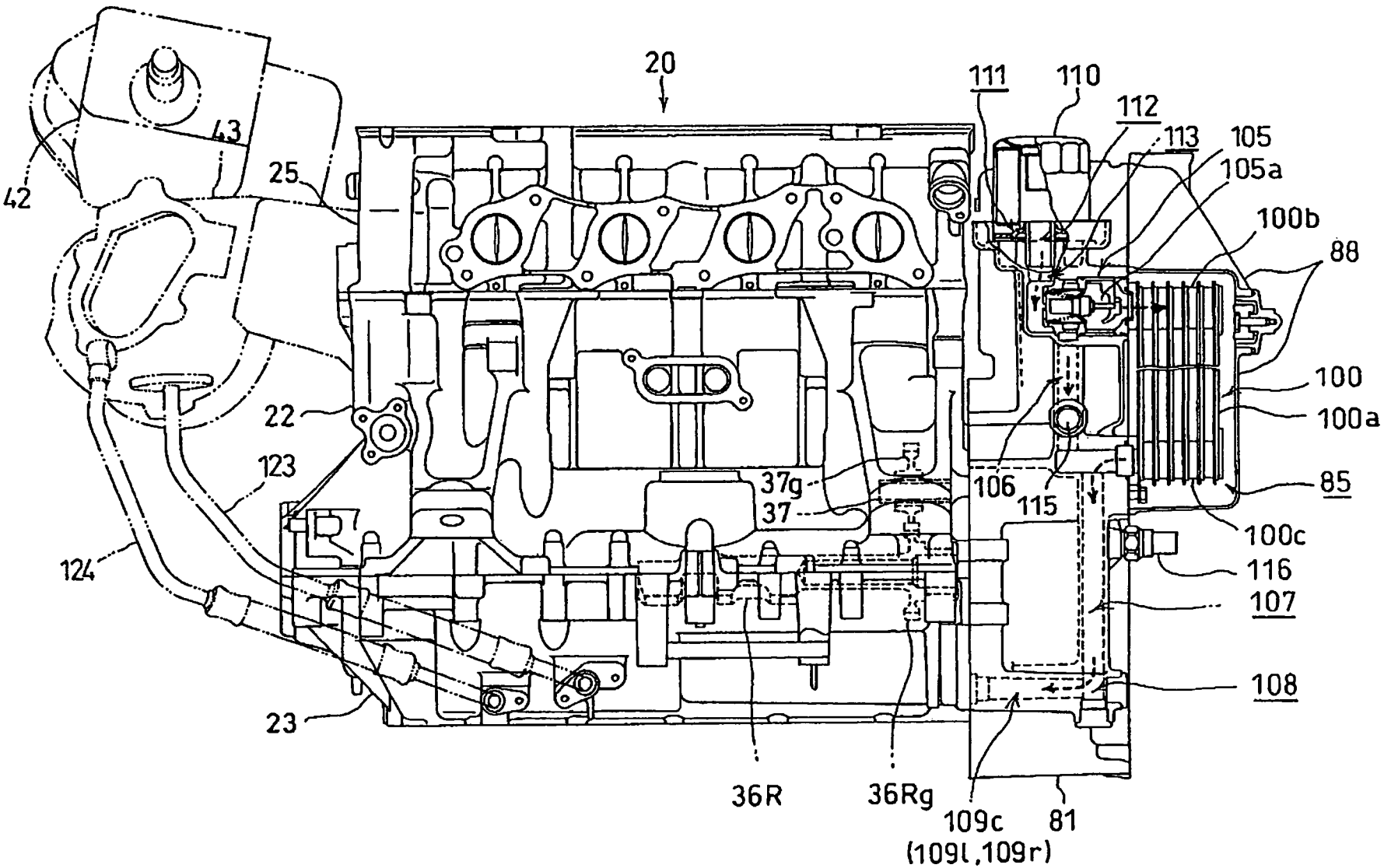
FIG. 10 is a right-side view, partially cut away and partially omitted, of the internal combustion engine.

As shown in FIGS. 4 and 10, a water-cooling type oil cooler 100 is provided so as to project from the vertically elongated oil-cooler accommodating portion 85 defined in the front surface of the tank body 81.

The oil cooler 100 includes a plurality of heat-exchange plates 100*a* through which oil passes, an upstream-side pipe 100*b* whose upper portion communicates with the inner portions of the plates 100*a*, and a downstream-side pipe 100*c* whose lower portion communicates with the inner portions of the plates 100*a*. The upstream-side pipe 100*b* and the downstream-side pipe 100*c* are respectively connected to upper and lower holes formed on the tank body 81 side, thereby attaching the oil cooler 100 to the tank body 81.

As shown in FIG. 10, the oil cooler 100 is covered from the front by a part of the tank cover 88. Cooling water flows into/out of the oil-cooler accommodating portion 85 inside the oil cooler 100, thereby cooling the oil in the oil cooler 100.

As shown in FIG. 10, at a position in the rear of the upstream-side pipe 100*b*, the upper hole of the tank body 81 to which the upstream-side pipe 100*b* of the oil cooler 100 is connected communicates with one outlet of an oil thermostat 105 including a switching valve 105*a*, and the lower hole to which the downstream-side pipe 100*c* of the oil cooler 100 is connected communicates with an oil vertical passage 107, which is an oil passage on the downstream side of the oil cooler 100 and extends downwardly.

The other outlet of the oil thermostat 105 detours around the oil cooler 100 and communicates with a bypass oil passage 106 that connects to the oil vertical passage 107.

Further, as shown in FIG. 10, the inlet of the oil thermostat 105 communicates via an upstream-side oil passage 113 of the oil cooler 100 with an oil outlet 112 of the oil filter 110 that is attached above the oil thermostat 105.

As mentioned above, in the oil filter 110, the oil that has been pressure-fed by the feed pump 90F flows in from the oil inlet 111, and the filtered oil flows out from the oil outlet 112.

In the oil thermostat 105, due to the movement of the switching valve 105*a*, the oil cooler 100 side is opened and the bypass oil passage 106 side is closed when the temperature of lubricating oil is equal to or higher than a predetermined temperature, and the bypass oil passage 106 side is opened and the oil cooler 100 side is closed when the temperature of lubricating oil is lower than the predetermined temperature.

In the bypass oil passage 106, a low-pressure oil switch 115 is attached to detect an abnormal decrease in oil pressure. Further, in the oil vertical passage 107 located downstream from the oil cooler 100 and the bypass oil passage 106, a high-pressure oil switch 116 is attached to detect an abnormal increase in oil pressure.

As shown in FIG. 10, while the low-pressure oil switch 115 is attached to the bypass oil passage 106 so as to project to the right side, the high-pressure oil switch 116 is attached to the oil vertical passage 107, which extends vertically, so as to project forward by utilizing the space below the oil cooler 100.

As indicated by the broken line in FIG. 4, the oil vertical passage 107 is bent to the left in a lower portion of the tank body 81 to communicate with an oil horizontal passage 108. The oil horizontal passage 108 has three branching paths extending rearwardly A main-gallery supply passage 109*c* for supplying oil to the main gallery of the internal combustion engine 20 is provided at the center, and a left-balancer supply passage 1091, and a right-balancer supply passage 109*r* for supplying oil to the bearing portions of the left and right balancer shafts 36L, 36R are formed at the left and right ends, respectively, see FIG. 13.

As shown in FIG. 9, the main galley supply passage 109*c* is connected to the main oil passage 23C of the above-mentioned crankcase 23. Oil is supplied from the main oil passage 23C to the respective bearing portions of the crankshaft 21 while being distributed through the passages in the ribs 23*r*.

The left-balancer supply passage 1091 and the right-balancer supply passage 109*r* are respectively connected to the left-balancer oil passage 23L and the right-balancer oil passage 23R mentioned above, see FIG. 13. Oil vertical passages 23La, 23Ra extending upwardly from the left-balancer oil passage 23L and the right-balancer oil passage 23R communicate with the bearings of the left and right balancer shafts 36L, 36R, respectively. Oil is thus supplied to the respective bearings, see FIG. 8.

Further, the oil vertical passage 23Ra on the right side reaches the parting surface 24 between the crankcase 23 and the cylinder block 22, and further communicates with the oil vertical passage 22Ra formed in the cylinder block 22 to reach the bearing of the intermediate shaft 37. Oil is thus supplied to the bearing of the intermediate shaft 37.

Figure 17:
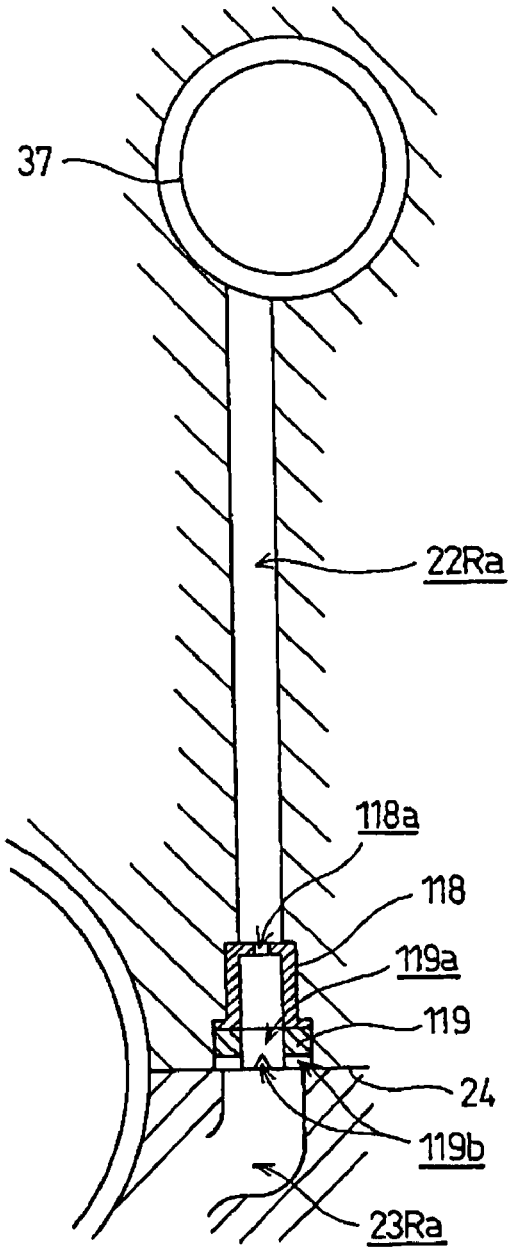
FIG. 17 is an enlarged main-portion sectional view of an oil vertical passage.

Referring to FIG. 17 showing the connecting portion between the oil vertical passage 23Ra on the crankcase 23 side and the oil vertical passage 22Ra on the cylinder block 22 side, in the lower portion of the oil vertical passage 22Ra, there are sequentially formed an intermediate-diameter circular hole portion with an enlarged inner diameter, and a large-diameter circular hole portion that is further enlarged in diameter than the intermediate-diameter circular hole portion. The large-diameter circular hole portion opens in the parting surface 24, thereby establishing communication with the oil vertical passage 23Ra on the crankcase 23 side.

Further, an orifice member 118, which is in the form of a flanged bottomed cylinder and has a small hole 118*a* at the bottom portion, is mounted with its cylinder portion fitted into the intermediate-diameter circular hole portion of the oil vertical passage 22Ra, and with its flange portion brought into fitting engagement with the large-diameter circular hole portion. Further, a hollow disc-shaped filter 119 is brought into fitting engagement with the large diameter circular hole portion in a manner overlapping the flange portion.

Figure 18:
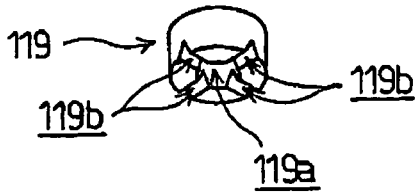
FIG. 18 is a perspective view of a filter.

The filter 119 has the same outer diameter as the large-diameter circular hole portion, and a hollow circular hole 119*a* thereof has substantially the same inner diameter as the oil vertical passage 22Ra. As shown in FIG. 18, V-groove 119*b* is formed in the shape of a cross in the surface of the filter 119 which becomes the lower side upon fitting engagement with the large-diameter circular hole portion of the oil vertical passage 22Ra.

When the flange portion of the orifice member 118 and the filter 119 are brought into fitting engagement with the large-diameter circular hole portion of the oil vertical passage 22Ra, the lower surface of the filter 119 becomes flush with the parting surface 24 of the cylinder block 22, and upon overlapping the cylinder block 22 and the crankcase 23 each other, the opening end face of the oil vertical passage 23Ra holds down the outer edge portion of the filter 119. The filter 119 is thus supported in place together with the orifice member 118.

Accordingly, the flow of oil passing through the oil vertical passage 23Ra and the oil vertical passage 22Ra to be supplied to the bearing of the intermediate shaft 37 is constricted at the location of the parting surface 24 by the orifice member 118. In this case, the filter 119 is arranged immediately before this location, so that even when such foreign matter as will clog the small hole 118*a* of the orifice member 118 flows in, this is blocked by the lower surface of the filter 119, and oil is made to flow via the V-groove 119*b* formed in the shape of a cross, thereby securing the supply of oil to the bearing of the intermediate shaft 37 at all times.

In addition, oil is supplied from the main oil passage 23C to the bearings of the cam shafts 35L 35E located above, and oil is also supplied to the turbo-charger 43, thereby forming a circulation path that returns to the oil pan 27.

Figure 19:
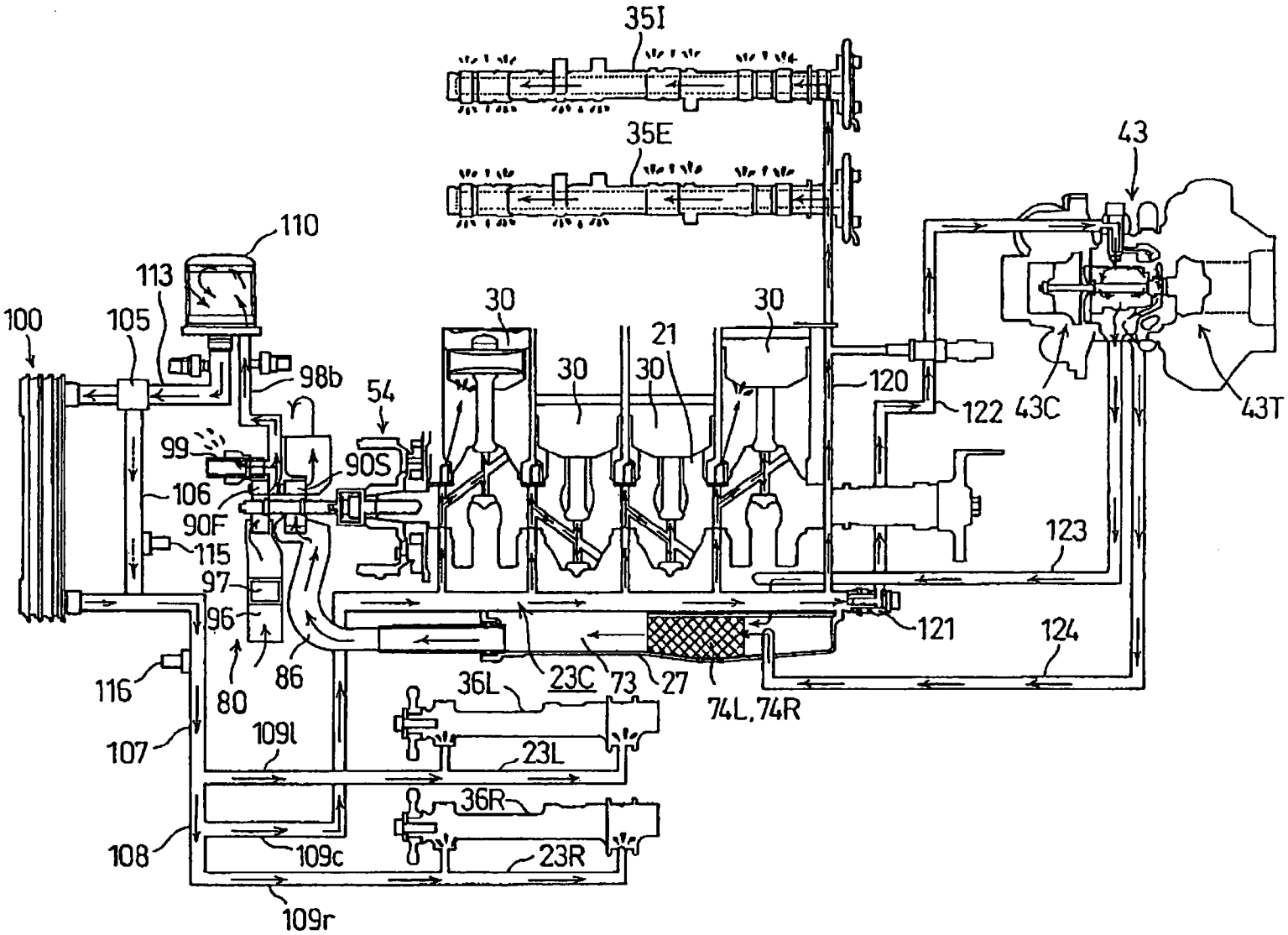
FIG. 19 is a view showing the circulation path of lubricating oil.

The overview of the above-described circulation path of lubricating oil, as shown in FIG. 19, will be described.

The lubricating oil that has accumulated in the oil pan 27 is sucked up by the drive of the scavenging pump 90S, is filtered via the oil strainers 74L, 74R, and passes through the oil recovery passages 73, 86 to be sucked into the scavenging pump 90S. The lubricating oil discharged from the scavenging pump 90S is recovered into the oil tank 80.

The lubricating oil that has been recovered into the oil tank 80 is sucked up by the drive of the feed pump 90F, and sucked into the filter pump 90F via the screen oil filter 97. The lubricating oil discharged from the feed pump 90F passes through the horizontal hole 98*a* and the vertical hole 98*b* and flows into the oil filter 110 via the relief valve 99. The lubricating oil is then filtered before reaching the oil thermostat 105.

In the oil thermostat 105, when the temperature of lubricating oil is equal to or higher than a predetermined temperature, the switching valve 105*a* opens the oil cooler side 100 so that lubricating oil flows through the oil cooler 100 and is cooled. On the other hand, when the temperature of lubricating oil is lower than the predetermined temperature, the switching valve 95*a* opens the bypass oil passage 106 side so that lubricating oil flows through the bypass oil passage 106 and then flows into the oil vertical passage 107 located on the downstream side without being cooled.

It should be noted that the low-pressure oil switch 115 is attached to the bypass oil passage 106, and the high-pressure oil switch 116 is attached to the oil vertical passage 107.

The lubricating oil flowing downwardly through the oil vertical passage 107 is branched at the location of the oil horizontal passage 108 at the lower end to three branching paths and flows to the rear in a lower portion of the crankcase 23.

The lubricating oils branched to the left and right balancer supply passages 1091, 109*r* pass through the left-balancer and the right-balancer oil passages 23L, 23R to be supplied to the bearings of the left and right balancer shafts 36L, 36R, respectively.

It should be noted that as mentioned above, the lubricating oil supplied to the left balancer shaft 36R is further supplied to the intermediate shaft 37 as well.

The lubricating oil branched to the main-gallery supply passage 109*c* at the center passes through the main oil passage 23C while being further branched to be supplied to the respective bearing portions of the crankshaft 21.

It should be noted that the lubricating oil supplied to the respective bearing portions of the crankshaft 21 passes through an oil passage formed in the crankshaft 21 to be supplied to the connecting portion with the large-end portion of the connecting rod 31.

Further, a cam-shaft oil supply channel 120 is formed so as to extend upwardly from the main oil passage 23C. The lubricating oil that has ascended through the cam-shaft oil supply channel 120 flows to an oil passage in each of the left and right cam shafts 351, 35E to be supplied to each bearing and each cam surface from the oil passage in the shaft.

The lubricating oil that has lubricated the crankshaft 21, the left and right balancer shafts 36L, 36R, the left and right cam shafts 35I, 35E, and the like finally returns to the oil pan 27.

Further, a turbo oil-supply pipe 122 extends from the main oil passage 23C to the turbo-charger 43 via an oil filter 121. A part of the lubricating oil that has flown to the main oil passage 23C is supplied to the turbocharger 43 through the turbo oil-supply pipe 122.

The lubricating oil supplied to the turbo-charger 43 separates into two flows, one for lubricating the bearings and the other for blocking heat on the turbine side to effect cooling. The two flows are returned to the oil pan 27 by means of two oil discharge pipes 123, 124.

On the other hand, the cooling system of the internal combustion engine 20 mounted in the small planing boat 1 utilizes water on which the small planing boat 1 floats. FIG. 20 shows the circulation path of cooling water.

Cooling water is introduced via a cooling-water introduction hose A from a cooling water inlet port 131 on the downstream positive-pressure side of the impeller 11 of the jet propulsion pump 10. The cooling-water introduction hose A is branched on the downstream side of a one-way valve 132 to a cooling water hose B1 and to a cooling water hose C1 to form a first cooling water path B and a second cooling water path C.

The first cooling water path B is a path leading to the internal combustion engine main body 20A via the intercooler 42 and the exhaust manifold 44. The cooling water hose B1 is connected to an inflow connecting pipe 42*a* on the left side of the intercooler 42, and a cooling water hose B2 that extends to the other side from an outflow connecting pipe 42*b* on the right side of the intercooler 42 is connected to an inflow joint member 44*b* attached to the rear portion of the exhaust manifold 44, see FIGS. 5, 6 and 7.

As shown in FIGS. 5 and 6, a cooling water hose B3 is connected to an outflow joint member 44*c* attached to the upper portion of the exhaust manifold 44. A cooling water hose B4 is connected to the cooling water hose B3 via a branching connecting pipe D. The cooling water hose B4 is connected to a lead-in joint member 22*a* of the cylinder block 22.

The water jacket of the cylinder block 22 communicates with the water jacket of the cylinder head 23.

Accordingly, in the first cooling-water path B, the cooling water that has passed through the cooling water hose B1 flows into the intercooler 42 to cool the intake air, and then passes through the cooling water hose B2 and flows into the exhaust manifold 44 to cool the exhaust manifold 44. The cooling water then passes through the cooling water hoses B3, B4 and flows into the water jacket of the cylinder block 22 of the internal combustion engine 20, and circulates in the water jacket of the cylinder block 22 and the water jacket of the cylinder head 23 to cool the internal combustion engine 20 before being discharged outside of the boat.

On the other hand, the second cooling-water path C is a path leading to the exhaust pipe 47*a* via the oil cooler 100. The cooling water hose C1 is connected to an inflow connecting pipe 85*a* in a lower portion of the oil-cooler accommodating portion 85 in the oil cooler 100. A cooling water hose C2 extending from a cooling-water outflow portion 85*b* in an upper portion of the oil-cooler accommodating portion 85 is connected to a cooling water hose C3 via the branching connecting pipe D. The cooling water hose C3 is connected to a cooling water hose C4 via a connecting pipe 135 installed in an upper portion of the exhaust manifold 44. The cooling water hose C4 extends to the rear along the right-side surface of the cylinder head cover 26 to be connected to an inflow connecting pipe 43*a* of the turbo-charger 43, see FIGS. 5 and 6.

As shown in FIG. 20, the cooling water that has flown into the turbo-charger 43 reaches the exhaust pipe 47*a*, and after the exhaust pipe 47*a*, sequentially passes through the backflow prevention chamber 47*b*, the water muffler 47*c*, and the piping 47*d* before reaching the water chamber 47*e*.

Accordingly, in the second cooling-water path C, the cooling water that has passed through the cooling water hose C1 flows into the oil-cooler accommodating portion 85 of the oil cooler 100 to cool lubricating oil, and then passes through the cooling water hoses C2, C3, C4 and flows into the turbo-charger 43 to cool the turbo-charger 43. Thereafter, the cooling water reaches the exhaust pipe 47*a*, takes in the exhaust air while cooling the exhaust pipe 47*a*, and sequentially passes through the backflow prevention chamber 47*b*, the water muffler 47*c*, and the piping 47*d* before reaching the water chamber 47*e* leading into the water to be discharged into the water.

The branching connecting pipe D, which is commonly used for the first cooling-water path B and the second cooling-water path C described above, also forms a bypass passage communicating between the cooling water hose C2 located downstream of the oil-cooler accommodating portion 85 of the oil cooler 100, and the cooling water hose B4 located upstream of the water jacket of the cylinder block 22.

Accordingly, a part of the cooling water that has passed through the oil cooler 100 is mixed, via the branching connecting pipe D, into the cooling water that has passed through the exhaust manifold 44, and flows into the water jacket of the cylinder block 22.

The cooling system of the internal combustion engine 20 according to this embodiment is configured as described above.

When the cooling water introduced from the cooling water inlet port 131 of the jet propulsion pump 10 is made to directly flow to the water jackets of the cylinder block 22 and cylinder head 23 of the internal combustion engine 20, supercooling may occur before the internal combustion engine 20 is warmed up, resulting in so-called dilution whereby fuel passes through the gap between the piston and the cylinder and dissolves into lubricating oil to dilute the lubricating oil.

In view of this, in the cooling system according to this embodiment, in the first cooling-water path B mentioned above, the cooling water that has been raised in temperature through the exhaust manifold 44 that warms up quickly is made to flow into the water jacket of the cylinder block 22 via the cooling water hoses B3, B4 to alleviate dilution, thereby suppressing oil degradation.

Once the internal combustion engine 20 has been warmed up, the temperature of the cooling water that has passed through the exhaust manifold 44 is too high to efficiently cool the internal combustion engine 20. In view of this, the cooling system according to this embodiment includes the branching connecting pipe D that also serves as a bypass passage communicating between the cooling water hose C2, which is located downstream of the oil-cooler accommodating portion 85, and the cooling water hose B4. A part of the cooling water that has passed through the oil cooler 100 and whose temperature is not so high is made to pass through the branching connecting pipe D to be mixed into the cooling water that has passed through the exhaust manifold 44. The cooling water that is made to flow into the water jacket of the cylinder block 22 is thus maintained at an appropriate temperature.

Further, in the lubricating system mentioned above, when the temperature of lubricating oil is equal to or higher than a predetermined temperature, the oil thermostat 105 opens the oil cooler 100 side to cool the lubricating oil, thus promoting the cooling of the internal combustion engine 20.

On the other hand, when the temperature of lubricating oil is lower than the predetermined temperature, the oil thermostat 105 opens the bypass oil passage 106 side so that the lubricating oil is bypassed without passing through the oil cooler 100. Accordingly, the lubricating oil is not cooled, thereby promoting warm-up and preventing supercooling from occurring during cold running.

As mentioned above, in the internal combustion engine 20 according to this embodiment, the rear end portions of the vertical left- and right-side walls of the frame wall 72 forming the cavity 79 constituting a longitudinally elongated oil passage within the oil pan 27 are cut away to form the communication openings on both left and right sides, and the oil strainers 74L, 74R are interposed in a vertical position in both the communication openings to divide the cavity 79 into an inside and outside. Accordingly, a sufficient space can be secured on the left and right sides of the oil strainers 74L, 74R while securing a sufficient filtering surface area, and the lateral width and vertical width of the oil pan 27 can be reduced, thereby facilitating conformity to the configuration of the center bottom portion of the small planing boat 1 slanting laterally upwardly. Further, the total height of the internal combustion engine 20 can be lowered.

Since the communication openings in which the oil strainers 74L, 74R are interposed are provided in the rear end portion of the internal combustion engine main body 20A, upon acceleration of the small planing boat 1, the oil inside the oil pan 27 becomes accumulated at the rear of the internal combustion engine 20. Accordingly, even when the amount of stored oil is small, it is possible to secure the oil that passes through the oil strainers 74L, 74R.

Of the left and right oil strainers 74L, 74R, the oil strainer 74R on the right side is inclined toward the center as it extends to the rear. It is thus possible to secure a large filtering surface area for the oil strainer 74R provided in the rear end portion of the internal combustion engine main body 20A, and allow oil to be efficiently filtered by the left and right oil strainers 74L, 74R forming a V-shape to be recovered into the oil pump.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An internal combustion engine for a small planing boat, in which an internal combustion engine for driving a jet propulsion pump is mounted inside a boat body surrounded by a hull and a deck, with a crankshaft orientated in a longitudinal direction of the boat body, wherein: an oil pan is provided at a bottom portion of the internal combustion engine;

an oil passage that communicates with an oil pump is formed inside the oil pan;

the oil passage having at least one vertical wall which extends in the longitudinal direction of the boat body, the at least one vertical wall being partially cut away to form a first communication opening communicating between an inside and an outside of the oil passage; and a first oil strainer is interposed in the first communication opening substantially vertically so as to divide the oil passage into the inside and the outside, so that the first oil strainer extends substantially vertically and substantially parallel to the longitudunal direction of the boat body.

2. The internal combustion engine for a small planing boat according to claim 1, wherein the first communication opening of the oil passage in which the first oil strainer is interposed is formed in a rear end portion of a main body of the internal combustion engine.

3. The internal combustion engine for a small planing boat according to claim 1, wherein the oil strainer is held between the oil pan and a crankcase of the internal combustion engine.

4. The internal combustion engine for a small planing boat according to claim 2, wherein the first oil strainer is held between the oil pan and a crankcase of the internal combustion engine.

5. The internal combustion engine for a small planing boat according to claim 2, wherein: the oil passage is formed in a longitudinally elongated configuration at a center portion of the oil pan; and the at least one vertical wall including a left vertical wall and a right vertical wall which extend substantially parallel to the longitudinal direction of the boat body, the first communication opening is formed in a rear portion of one of the left and right vertical walls of the oil passage, and further comprising:

a second communication opening formed in a rear portion of the other of the left and right vertical walls, and a second oil strainer being interposed in the second communication opening.

6. The internal combustion engine for a small planing boat according to claim 2, wherein: the oil passage is formed in a longitudinally elongated configuration at a center portion of the oil pan; and the at least one vertical wall including a left vertical wall and a right vertical wall which extend substantially parallel to the longitudinal direction of the boat body, the first communication opening is formed in a rear portion of one of the left and right vertical walls of the oil passage, and further comprising:

a second communication opening formed in a rear portion of the other of the left and right vertical walls, and a second oil strainer being interposed in the second communication opening.

7. The internal combustion engine for a small planing boat according to claim 1, wherein: the oil passage, which communicates with the oil pump, opens in a front wall of the oil pan.

8. An internal combustion engine adapted to be used with a small planing boat, in which an internal combustion engine for driving a jet propulsion pump is mounted inside a boat body surrounded by a hull and a deck, with a crankshaft orientated in a longitudinal direction of the boat body, comprising:

an oil pan provided at a bottom portion of the internal combustion engine;

an oil passage for communicating with an oil pump is formed inside the oil pan;

a communication opening being formed to communicate in a lateral direction of the boat body between the inside and outside of the oil passage; and an oil strainer interposed in the communication opening so as to divide the oil passage into an inside and an outside, wherein the communication opening is a substantially U-shaped opening that faces left and right, the communication opening including grooves formed on three inner edge portions thereof, and the oil strainer is fitted in the grooves in a posture that is substantially vertical and substantially parallel to the longitudinal direction of the boat body.

9. The internal combustion engine adapted to be used with a small planing boat according to claim 8, wherein the communication opening of the oil passage in which the oil strainer is interposed is formed in a rear end portion of a main body of the internal combustion engine.

10. The internal combustion engine adapted to be used with a small planing boat according to claim 8, wherein the oil strainer is held between the oil pan and a crankcase of the internal combustion engine.

11. An internal combustion engine adapted to be used with a small planing boat, in which an internal combustion engine for driving a jet propulsion pump is mounted inside a boat body surrounded by a hull and a deck, with a crankshaft orientated in a longitudinal direction of the boat body comprising:

an oil pan provided at a bottom portion of the internal combustion engine;

an oil passage for communicating with an oil pump is formed inside the oil pan;

a communication opening being formed to communicate between an inside and an outside of the oil passage; and an oil strainer interposed in the communication opening so as to divide the oil passage into an inside and an outside, wherein the oil strainer is held in a substantially vertical position, spans a distance between the oil pan and a crankcase of the internal combustion engine, and is inclined toward a center of the oil pan as the oil strainer extends toward a rear of the small planing boat.

12. The internal combustion engine adapted to be used with a small planing boat according to claim 8, wherein: the oil passage is formed in a longitudinally elongated configuration at a center portion of the oil pan; and the communication opening is formed in a rear portion of each of left and right vertical walls of the oil passage, the left and right walls extending substantially parallel to the longitudinal direction of the boat body, the left and right oil strainers being interposed, respectively, in each of the communication openings formed in the left and right vertical walls.

13. The internal combustion engine adapted to be used with a small planing boat according to claim 8, wherein: the oil passage, which communicates with the oil pump, opens in a front wall of the oil pan.

14. The internal combustion engine adapted to be used with a small planing boat according to claim 11, wherein: the oil passage is formed in a longitudinally elongated configuration at a center portion of the oil pan; and the communication opening is formed in a rear portion of each of left and right vertical walls of the oil passage, the left and right walls extending substantially parallel to the longitudinal direction of the boat body, wherein the oil strainer includes left and right oil strainers, each having the posture substantially vertical and substantially parallel to the longitudinal direction of the boat body, the left and right oil strainers being interposed, respectively, in each of the communication openings formed in the left and right vertical walls.

15. The internal combustion engine adapted to be used with a small planing boat according to claim 12, wherein at least one of the left and right oil strainers is inclined toward the center as the oil strainer extends rearward.

16. The internal combustion engine adapted to be used with a small planing boat according to claim 14, wherein at least one of the left and right oil strainers is inclined towards the center as the oil strainer extends rearward.

* * * * *